US008764548B2

(12) United States Patent
Spark-Stahl et al.

(10) Patent No.: US 8,764,548 B2
(45) **Date of Patent: *Jul. 1, 2014**

(54) GAMING SYSTEM, GAMING DEVICE, AND METHOD FOR PROVIDING A DIRECTIONAL SYMBOL EVALUATION GAME

(75) Inventors: George Spark-Stahl, Reno, NV (US); Bryan D. Wolf, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/214,741

(22) Filed: Aug. 22, 2011

(65) Prior Publication Data

US 2013/0053128 A1 Feb. 28, 2013

(51) Int. Cl.
*A63F 9/24* (2006.01)

(52) U.S. Cl.
USPC ..... 463/20; 463/16

(58) Field of Classification Search
USPC ..... 463/16, 20
See application file for complete search history.

(56) References Cited

U.S. PATENT DOCUMENTS

| | | | |
|---|---|---|---|
| 4,170,358 | A | 10/1979 | Hancock |
| 4,198,052 | A | 4/1980 | Gauselmann |
| 4,448,419 | A | 5/1984 | Telnaes |
| 4,618,150 | A | 10/1986 | Kimura |
| 4,624,459 | A | 11/1986 | Kaufman |
| 4,695,053 | A | 9/1987 | Vazquez, Jr. et al. |
| 4,732,386 | A | 3/1988 | Rayfiel |
| 4,756,531 | A | 7/1988 | DiRe et al. |
| 4,826,169 | A | 5/1989 | Bessho et al. |
| 4,838,552 | A | 6/1989 | Hagiwara |
| 4,874,173 | A | 10/1989 | Kishishita |
| 4,991,848 | A | 2/1991 | Greenwood et al. |
| 5,019,973 | A | 5/1991 | Wilcox et al. |
| 5,085,436 | A | 2/1992 | Bennett |
| 5,092,598 | A | 3/1992 | Kamille |
| 5,102,134 | A | 4/1992 | Smyth |

(Continued)

FOREIGN PATENT DOCUMENTS

| | | |
|---|---|---|
| AU | 199917318 | 9/1999 |
| EP | 0 060 019 | 9/1982 |

(Continued)

OTHER PUBLICATIONS

Deal or No Deal Advertisement, written by Atronic, dated 2004.

(Continued)

*Primary Examiner* — Dmitry Suhol
*Assistant Examiner* — Jason Yen
(74) *Attorney, Agent, or Firm* — Neal, Gerber & Eisenberg LLP

(57) ABSTRACT

In one embodiment, a gaming system which may randomly generate a plurality of directional symbols. Each directional symbol may have an input direction and an output direction. The gaming system may analyze the generated directional symbols to determine whether any formed sets, chains or sequences of compatible directional symbols are associated with any awards. More specifically, the gaming system may determine whether to form any sets of compatible directional symbols based on if one or more input directions of one or more of the generated directional symbols are compatible with one or more output directions of one or more of the generated directional symbols. The gaming system then may determine and may provide a player an award based on one or more of any formed sets of compatible directional symbols.

20 Claims, 16 Drawing Sheets

(56) References Cited

U.S. PATENT DOCUMENTS 5,102,137 A 4/1992 Ekiert
5,209,479 A 5/1993 Nagao et al.
5,280,916 A 1/1994 Gleason, Jr.
5,308,065 A 5/1994 Bridgeman et al.
5,332,228 A 7/1994 Schultz
5,342,047 A 8/1994 Heidel et al.
5,344,144 A 9/1994 Canon
5,393,061 A 2/1995 Manship et al.
5,395,111 A 3/1995 Inoue
5,413,342 A 5/1995 Kaplan
5,423,539 A 6/1995 Nagao
5,431,408 A 7/1995 Adams
5,449,173 A 9/1995 Thomas et al.
5,542,669 A 8/1996 Charron et al.
5,569,084 A 10/1996 Nicastro et al.
5,580,053 A 12/1996 Crouch
5,580,055 A 12/1996 Hagiwara
5,584,764 A 12/1996 Inoue
5,609,524 A 3/1997 Inoue
5,611,535 A 3/1997 Tiberio
5,697,843 A 12/1997 Manship et al.
5,704,835 A 1/1998 Dietz, II
5,716,275 A * 2/1998 Wada et al. ..... 463/62
5,722,891 A 3/1998 Inoue
5,752,881 A 5/1998 Inoue
5,766,074 A 6/1998 Cannon et al.
5,769,716 A 6/1998 Saffari et al.
5,772,509 A 6/1998 Weiss
5,775,692 A 7/1998 Watts et al.
5,788,573 A 8/1998 Baerlocher et al.
5,807,172 A 9/1998 Piechowiak
5,810,361 A 9/1998 Kadlic
5,823,873 A 10/1998 Moody
5,823,874 A 10/1998 Adams
5,833,536 A 11/1998 Davids et al.
5,833,537 A 11/1998 Barrie
5,848,932 A 12/1998 Adams
5,851,148 A 12/1998 Brune et al.
5,855,514 A 1/1999 Kamille
5,882,261 A 3/1999 Adams
5,890,962 A 4/1999 Takemoto
5,902,184 A 5/1999 Bennett et al.
5,919,088 A 7/1999 Weiss
5,927,714 A 7/1999 Kaplan
5,931,467 A * 8/1999 Kamille ..... 273/139
5,947,820 A 9/1999 Morro et al.
5,951,397 A 9/1999 Dickinson
5,976,016 A 11/1999 Moody et al.
5,980,384 A * 11/1999 Barrie ..... 463/16
5,984,781 A 11/1999 Sunaga
5,984,782 A 11/1999 Inoue
5,996,997 A * 12/1999 Kamille ..... 273/139
5,997,400 A 12/1999 Seelig et al.
5,997,401 A 12/1999 Crawford
6,004,207 A 12/1999 Wilson, Jr. et al.
6,004,208 A 12/1999 Takemoto et al.
6,015,346 A 1/2000 Bennett
6,027,115 A 2/2000 Griswold et al.
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,095,921 A 8/2000 Walker et al.
6,102,798 A 8/2000 Bennett
6,113,098 A 9/2000 Adams
6,120,031 A 9/2000 Adams
6,120,377 A 9/2000 McGinnis, Sr. et al.
6,120,378 A 9/2000 Moody
6,123,333 A 9/2000 McGinnis, Sr. et al.
6,126,542 A 10/2000 Fier
6,142,873 A 11/2000 Weiss et al.
6,142,874 A 11/2000 Kodachi et al.
6,142,875 A 11/2000 Kodachi et al.
6,146,273 A 11/2000 Olsen
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,165,070 A 12/2000 Nolte et al.
6,168,520 B1 1/2001 Baerlocher et al.
6,174,233 B1 1/2001 Sunaga et al.
6,186,894 B1 2/2001 Mayeroff
6,190,254 B1 2/2001 Bennett
6,190,255 B1 2/2001 Thomas et al.
6,200,217 B1 3/2001 Osawa
6,203,429 B1 3/2001 Demar et al.
6,203,430 B1 3/2001 Walker et al.
6,220,959 B1 4/2001 Holmes, Jr. et al.
6,224,483 B1 5/2001 Mayeroff
6,227,971 B1 5/2001 Weiss
6,231,442 B1 5/2001 Mayeroff
6,231,445 B1 5/2001 Acres
6,234,897 B1 5/2001 Frohm et al.
6,241,607 B1 6/2001 Payne et al.
6,251,013 B1 6/2001 Bennett
6,261,177 B1 7/2001 Bennett
6,261,178 B1 7/2001 Bennett
6,270,409 B1 8/2001 Shuster
6,270,411 B1 8/2001 Gura et al.
6,299,165 B1 10/2001 Nagano
6,299,170 B1 10/2001 Yoseloff
6,302,398 B1 10/2001 Vecchio
6,309,299 B1 10/2001 Weiss
6,309,300 B1 10/2001 Glavich
6,311,976 B1 11/2001 Yoseloff et al.
6,315,660 B1 11/2001 DeMar et al.
6,315,663 B1 11/2001 Sakamoto
6,315,664 B1 11/2001 Baerlocher et al.
6,319,124 B1 11/2001 Baerlocher et al.
6,322,078 B1 11/2001 Adams
6,328,649 B1 12/2001 Randall et al.
6,336,860 B1 1/2002 Webb
6,346,043 B1 2/2002 Colin et al.
6,347,996 B1 2/2002 Gilmore et al.
6,358,144 B1 3/2002 Kaddlic et al.
6,358,147 B1 3/2002 Jaffe et al.
6,364,314 B1 4/2002 Canterbury
6,364,766 B1 4/2002 Anderson et al.
6,375,570 B1 4/2002 Poole
6,394,902 B1 5/2002 Glavich et al.
6,398,218 B1 6/2002 Vancura
6,409,602 B1 6/2002 Wiltshire et al.
6,413,162 B1 7/2002 Baerlocher et al.
6,419,579 B1 7/2002 Bennett
6,439,943 B1 8/2002 Aoki et al.
6,439,993 B1 8/2002 O'Halloran
6,439,995 B1 8/2002 Hughs-Baird et al.
6,454,266 B1 9/2002 Breeding et al.
6,461,241 B1 10/2002 Webb et al.
6,464,581 B1 10/2002 Yoseloff et al.
6,491,584 B2 12/2002 Graham et al.
6,494,454 B2 12/2002 Adams
6,517,432 B1 2/2003 Jaffe
6,547,242 B1 4/2003 Sugiyama et al.
6,551,187 B1 4/2003 Jaffe
6,558,254 B2 5/2003 Baelocher et al.
6,561,900 B1 5/2003 Baerlocher et al.
6,572,472 B1 6/2003 Glavich
6,602,136 B1 8/2003 Baerlocher et al.
6,602,137 B2 8/2003 Kaminkow et al.
6,604,740 B1 8/2003 Singer et al.
6,604,999 B2 8/2003 Ainsworth
6,605,002 B2 8/2003 Baerlocher
6,609,971 B2 8/2003 Vancura
6,616,142 B2 9/2003 Adams
6,632,139 B1 10/2003 Baerlocher
6,634,945 B2 10/2003 Glavich et al.
6,676,511 B2 1/2004 Payne et al.

(56) References Cited

U.S. PATENT DOCUMENTS

| | | | | |
|---|---|---|---|---|
| 6,676,512 | B2 | 1/2004 | Fong et al. | |
| 6,733,386 | B2 | 5/2004 | Cuddy et al. | |
| 6,805,349 | B2 | 10/2004 | Baerlocher et al. | |
| 6,869,357 | B2 | 3/2005 | Adams et al. | |
| 6,896,615 | B2 | 5/2005 | Berman | |
| 6,905,406 | B2 | 6/2005 | Kaminkow et al. | |
| 6,960,133 | B1 | 11/2005 | Marks et al. | |
| 6,966,835 | B2 | 11/2005 | Graham | |
| 7,001,274 | B2 | 2/2006 | Baerlocher et al. | |
| 7,014,560 | B2 | 3/2006 | Glavich et al. | |
| 7,156,736 | B2 | 1/2007 | Adams et al. | |
| 7,419,431 | B2 * | 9/2008 | Gauselmann et al. | 463/30 |
| 7,481,435 | B2 | 1/2009 | Shetterly | |
| 7,717,787 | B2 | 5/2010 | Walker et al. | |
| 7,758,414 | B1 * | 7/2010 | Marks et al. | 463/20 |
| 7,874,910 | B2 | 1/2011 | Berman | |
| 7,922,573 | B2 | 4/2011 | Baerlocher et al. | |
| 2001/0054794 | A1 | 12/2001 | Cole et al. | |
| 2002/0014740 | A1 | 2/2002 | Ainsworth | |
| 2002/0025844 | A1 | 2/2002 | Casey et al. | |
| 2002/0055382 | A1 | 5/2002 | Meyer | |
| 2002/0065124 | A1 | 5/2002 | Ainsworth | |
| 2002/0094857 | A1 | 7/2002 | Meyer | |
| 2002/0119814 | A1 | 8/2002 | Fong et al. | |
| 2003/0013518 | A1 | 1/2003 | Graham | |
| 2003/0045345 | A1 | 3/2003 | Berman | |
| 2003/0069068 | A1 | 4/2003 | Kaminkow | |
| 2003/0092480 | A1 | 5/2003 | White et al. | |
| 2003/0114215 | A1 | 6/2003 | Adams et al. | |
| 2003/0203752 | A1 * | 10/2003 | Kaminkow et al. | 463/20 |
| 2003/0216165 | A1 | 11/2003 | Singer et al. | |
| 2004/0009803 | A1 | 1/2004 | Bennett et al. | |
| 2004/0023714 | A1 | 2/2004 | Asdale | |
| 2004/0038727 | A1 * | 2/2004 | Aida | 463/20 |
| 2004/0048646 | A1 * | 3/2004 | Visocnik | 463/16 |
| 2004/0048650 | A1 | 3/2004 | Mierau et al. | |
| 2004/0058727 | A1 | 3/2004 | Marks et al. | |
| 2004/0097280 | A1 | 5/2004 | Gauselmann | |
| 2004/0192431 | A1 | 9/2004 | Singer et al. | |
| 2004/0232616 | A1 | 11/2004 | English | |
| 2004/0242314 | A1 | 12/2004 | Casey | |
| 2005/0054420 | A1 | 3/2005 | Cregan et al. | |
| 2005/0054429 | A1 | 3/2005 | Baerlocher et al. | |
| 2005/0054436 | A1 | 3/2005 | Frizzell et al. | |
| 2005/0107154 | A1 | 5/2005 | Pacey | |
| 2005/0124406 | A1 | 6/2005 | Cannon | |
| 2005/0148384 | A1 | 7/2005 | Marks et al. | |
| 2005/0170876 | A1 | 8/2005 | Masci et al. | |
| 2005/0192081 | A1 | 9/2005 | Marks et al. | |
| 2005/0230917 | A1 | 10/2005 | Jackson | |
| 2006/0003832 | A1 | 1/2006 | Mincey et al. | |
| 2006/0030387 | A1 * | 2/2006 | Jackson | 463/16 |
| 2006/0089191 | A1 | 4/2006 | Singer et al. | |
| 2007/0026923 | A1 | 2/2007 | Muir | |
| 2007/0060255 | A1 | 3/2007 | Baerlocher et al. | |
| 2007/0129134 | A1 | 6/2007 | Barrie | |
| 2007/0191087 | A1 | 8/2007 | Thomas et al. | |
| 2007/0265053 | A1 * | 11/2007 | Linard et al. | 463/16 |
| 2008/0045321 | A1 * | 2/2008 | Kato | 463/20 |
| 2008/0064466 | A1 * | 3/2008 | Saito | 463/16 |
| 2008/0108408 | A1 | 5/2008 | Wolf | |
| 2008/0254893 | A1 | 10/2008 | Patel et al. | |
| 2010/0075741 | A1 * | 3/2010 | Aoki et al. | 463/20 |
| 2011/0111825 | A1 | 5/2011 | Caputo | |
| 2011/0136562 | A1 * | 6/2011 | Loat et al. | 463/20 |
| 2011/0151961 | A1 * | 6/2011 | Stevens et al. | 463/20 |
| 2011/0223985 | A1 * | 9/2011 | Mizue | 463/20 |
| 2012/0302319 | A1 | 11/2012 | Linard et al. | |

FOREIGN PATENT DOCUMENTS

| | | |
|---|---|---|
| EP | 0 238 289 | 9/1987 |
| EP | 0 410 789 | 7/1990 |
| EP | 0 945 837 | 9/1999 |
| EP | 0 984 408 | 3/2000 |
| EP | 1 205 894 | 10/2001 |
| GB | 2 090 690 | 7/1982 |
| GB | 2 096 376 | 10/1982 |
| GB | 2 097 160 | 10/1982 |
| GB | 2 100 905 | 1/1983 |
| GB | 2 105 891 | 3/1983 |
| GB | 2 117 155 | 10/1983 |
| GB | 2 137 392 | 10/1984 |
| GB | 2 161 008 | 1/1986 |
| GB | 2170636 | 2/1986 |
| GB | 2 170 643 | 8/1986 |
| GB | 2 181 589 | 4/1987 |
| GB | 2 183 882 | 6/1987 |
| GB | 2 191 030 | 12/1987 |
| GB | 2 222 712 | 3/1990 |
| GB | 2 225 889 | 6/1990 |
| GB | 2 226 436 | 6/1990 |
| GB | 2 226 907 | 7/1990 |
| GB | 2 242 300 | 9/1991 |
| GB | 2 262 642 | 6/1993 |
| GB | 2 316 214 | 2/1998 |
| GB | 2 328 311 | 2/1999 |
| GB | 2 393 019 | 3/2004 |
| GB | 2 402 256 | 12/2004 |
| WO | WO 96/08799 | 3/1996 |
| WO | WO 97/32285 | 9/1997 |
| WO | WO 00/66235 | 11/2000 |
| WO | WO 00/76606 | 12/2000 |
| WO | WO 01/19476 | 3/2001 |
| WO | WO 01/87441 | 11/2001 |
| WO | WO 03/049055 | 3/2003 |
| WO | WO 03/026758 | 4/2003 |
| WO | WO 2004/025584 | 3/2004 |
| WO | WO 2004/082779 | 9/2004 |

OTHER PUBLICATIONS

Deal or No Deal Article, written by Strictly Slots, dated Sep. 2004.

* cited by examiner

GAMING SYSTEM, GAMING DEVICE, AND METHOD FOR PROVIDING A DIRECTIONAL SYMBOL EVALUATION GAME

CROSS-REFERENCE TO RELATED APPLICATIONS

This application relates to the following co-pending commonly owned patent applications: "GAMING SYSTEM, GAMING DEVICE, AND METHOD FOR PROVIDING A DIRECTIONAL SYMBOL EVALUATION GAME," Ser. No. 13/214,756.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a primary or base wager to activate the primary or base game. In many of these gaming machines, the award may be based on the player obtaining a winning symbol or symbol combination and on the amount of the primary or base wager (e.g., the higher the wager, the higher the award).

Certain known gaming machines may include a plurality of reels and one or more predetermined paylines. Such gaming machines may include a suitable number of reels, such as three to five reels, which each display any suitable number of symbols per reel, such as three symbols per reel. In such gaming machines, the player initiates the spinning of the reels by making one or more wagers on one or more paylines. Such gaming machines may have one, three, five, nine, fifteen, twenty-five or any other suitable number of predetermined paylines which may be horizontal, vertical, diagonal or any combination thereof. The player wagers on a player selected number or combination of predetermined paylines, such as one, two, three, five, ten or fifteen paylines and the reels may be activated to spin.

After the reels spin to display a plurality of symbols, these gaming machines analyze the displayed symbols to determine if the gaming machine may have randomly generated any winning symbols or winning symbol combinations on or along any of the wagered on predetermined paylines. Any awards associated with any winning symbols or winning symbol combinations generated along any wagered on predetermined paylines may be provided to the player. In such gaming machines, symbols or symbol combinations which are less likely to occur usually provide higher awards.

In other known types of gaming machines, a payout may be provided based on a "scatter pay." A scatter pay may include a pay for the occurrence of designated symbols anywhere on the symbol display. In these gaming machines, symbols generated on the symbol display may be evaluated for winning combinations as if the symbols were generated along a traditional payline of adjacently arranged symbols.

In another type of known gaming machines with reels, the player wagers on a number of ways to win, wherein any award provided to the player may be based on the number of associated symbols which may be generated in active symbol positions on a requisite number of adjacent reels. In these ways to win gaming machines, any award provided to the player may not be based on any paylines that would have passed through the generated winning symbol combination, but rather may be determined based on if any formed strings of related symbols on adjacent reels are associated with any awards.

There is a continuing need to increase player enjoyment and excitement, and specifically to increase player enjoyment and entertainment with new and different symbol evaluation features.

SUMMARY

The present disclosure relates generally to gaming systems, gaming devices, and methods for providing a symbol evaluation game, such as a directional symbol or directional tile evaluation game.

In various embodiments, the gaming system may randomly generate and may display a plurality of directional symbols or directional tiles. Each directional symbol may have one or more input directions and one or more output directions. In these embodiments, the gaming system may analyze the generated directional symbols to determine whether any formed sets, chains or sequences of compatible directional symbols are associated with any awards. More specifically, the gaming system may determine whether to form any sets of compatible directional symbols based on if one or more input directions of one or more of the generated directional symbols are compatible with one or more output directions of one or more of the other generated directional symbols. The gaming system then may determine and may provide a player an award based on one or more of any formed sets of compatible directional symbols. Such a gaming system may increase a player's level of excitement and enjoyment by providing one or more awards based on an evaluation of generated symbols that differs from known predetermined payline symbol evaluations.

Specifically, in one embodiment, the gaming system may enable a player to wager on one or more starting symbol display positions. After the player wagers on one or more starting symbol display positions, a plurality of directional symbol generators, such as a plurality of reels, generate and display a plurality of directional symbols at a plurality of the symbol display positions. Each directional symbol may have at least one of a plurality of different input directions and at least one of a plurality of different output directions. Each input direction may be compatible with or otherwise associated with at least one of the output directions. Moreover, each input direction may be incompatible with or otherwise not associated with at least one of the output directions. For example, an input direction of left is compatible with an output direction of right, but incompatible with an output direction of up.

Following this generation, the gaming system may determine, for each wagered on starting symbol display position, whether the output direction of the directional symbol generated at that starting symbol display position is compatible with an input direction of an indicated directional symbol generated at an indicated symbol display position. That is, the gaming system may determine whether the output direction of a directional symbol generated at a wagered on starting symbol display position indicates a compatible input direction of at least one directional symbol generated at at least one symbol display position adjacent to the starting symbol display position. For example, if the output direction of the generated symbol at a wagered on starting symbol display position is to the right, the gaming system may determine if a left direction (i.e., a compatible input direction) is the input direction of the generated directional symbol in the adjacent symbol display position which is to the right of the wagered on starting symbol display position.

If the gaming system determines that an output direction of the directional symbol generated at a wagered on starting symbol display position is compatible with an input direction of at least one directional symbol of at least one symbol display position indicated by that output direction, the gaming system may form a set, chain or sequence of compatible directional symbols for that wagered on starting symbol display position. On the other hand, if the gaming system determines that an output direction of the directional symbol generated at a wagered on starting symbol display position is incompatible with any input direction of any indicated directional symbols generated at any symbol display positions adjacent to the starting symbol display position, the gaming system may not form any set of compatible directional symbols for that wagered on starting symbol display position.

Following the formation of any sets of compatible directional symbols, if at least one set of compatible directional symbols is formed, the gaming system may determine, for each formed set of compatible directional symbols, whether to include one or more additional directional symbols in the formed set. Specifically, the gaming system may determine whether the output direction of the last or most recently added directional symbol included in the set is compatible with the input direction of any indicated directional symbols generated at any indicated symbol display positions adjacent to that directional symbol.

If the output direction of the last or most recently added directional symbol included in the set is incompatible with any input directions of any indicated directional symbols generated at any symbol display positions adjacent to that directional symbol (or no symbol display positions are adjacent to the symbol display position of that directional symbol), the gaming system may mark or flag the set of directional symbols as complete. On the other hand, if the output direction of the last or most recently added directional symbol included in the set is compatible with the input direction of at least one directional symbol indicated by that output direction, the gaming system may include the compatible adjacent directional symbol in the formed set and may proceed as described above with determining whether to include one or more additional directional symbols in the formed set.

After each of any formed sets of compatible directional symbols are complete, the gaming system may determine, for each complete formed set of compatible directional symbols, an award to provide to the player. For example, the gaming system may determine an award based on the quantity of directional symbols in the formed set. The gaming system then may provide the determined award to the player and may enable the player to place another wager on one or more starting positions as described above.

Accordingly, the gaming system and method disclosed herein may increase a player's excitement and enjoyment by utilizing certain of the generated symbols to determine which others symbols at which other symbol display positions may be evaluated. That is, rather than known payline evaluation games in which a player wagers on predetermined paylines (and thus knows which symbol display positions are along each predetermined payline), the gaming system and method disclosed herein may encode evaluation information into each directional symbol to dynamically determine each evaluation pattern as the symbol evaluation occurs.

Additional features and advantages are described in, and will be apparent from, the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which may be provided by the gaming machine or gaming device) may be provided with the gaming machine or gaming device prior to delivery to a gaming establishment; and (2) a changeable gaming machine, gaming device, or gaming system wherein the computerized instructions for controlling any games (which may be provided by the gaming machine or gaming device) may be downloadable to the gaming machine or gaming device through a data network after the gaming machine or gaming device is in a gaming establishment. In one embodiment, the computerized instructions for controlling any games may be executed by at least one central server, central controller, or remote host. In such a "thin client" embodiment, the central server remotely controls any games (or other suitable interfaces) and the gaming device may be utilized to display such games (or suitable interfaces) and receive one or more inputs or commands from a player. In another embodiment, the computerized instructions for controlling any games may be communicated from the central server, central controller, or remote host to a gaming device local processor and memory devices. In such a "thick client" embodiment, the gaming device local processor may execute the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device may be implemented in a thin client environment and certain other functions of the gaming device may be implemented in a thick client environment. In one such embodiment, computerized instructions for controlling any primary games may be communicated from the central server to the gaming device in a thick client configuration and computerized instructions for controlling any secondary games or bonus functions may be executed by a central server in a thin client configuration.

Figure 1A:
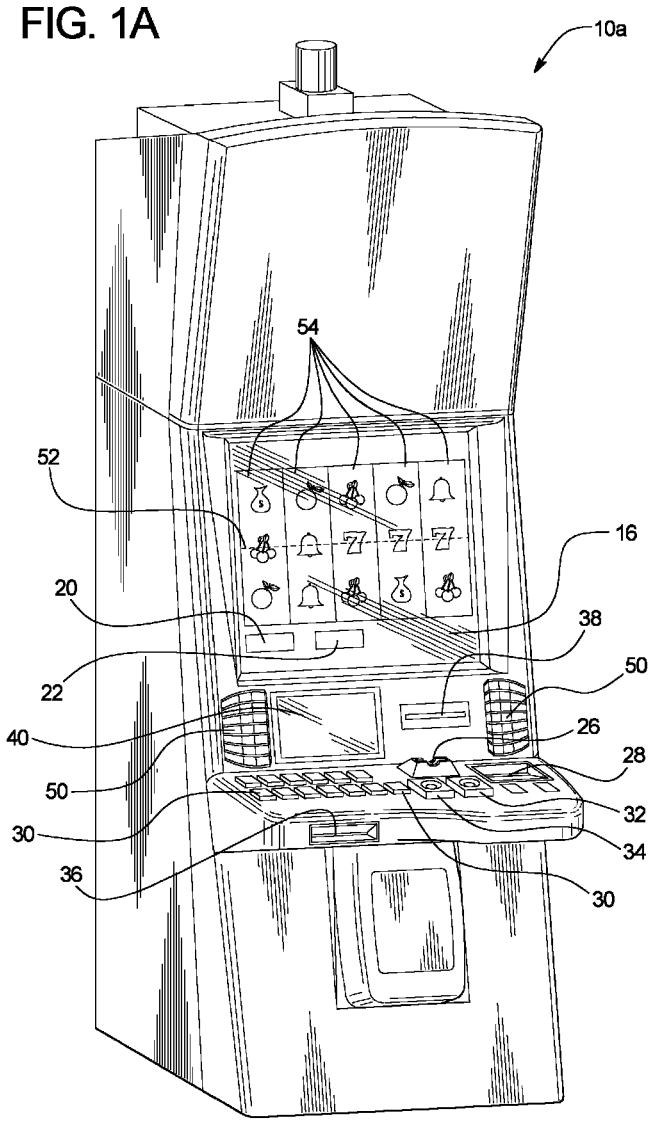
FIGS. 1A and 1B are perspective views of example alternative embodiments of the gaming device of the present disclosure.
Figure 1B:
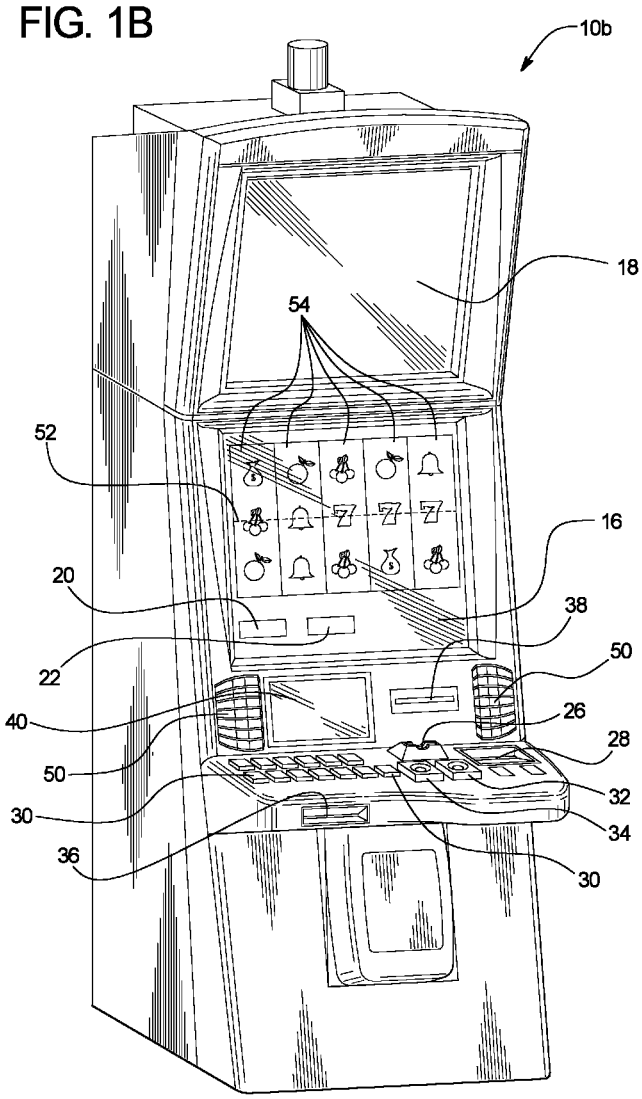

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 may have a support structure, housing, or cabinet which may provide support for a plurality of displays, inputs, controls, and other features of a conventional gaming machine. It is configured so that a player may operate it while standing or sitting. The gaming device may be positioned on a base or stand or may be configured as a pub-style table-top game (not shown) which a player may operate while sitting. As illustrated by the different configurations shown in FIGS. 1A and 1B, the gaming device may have varying cabinet and display configurations.

Figure 2A:
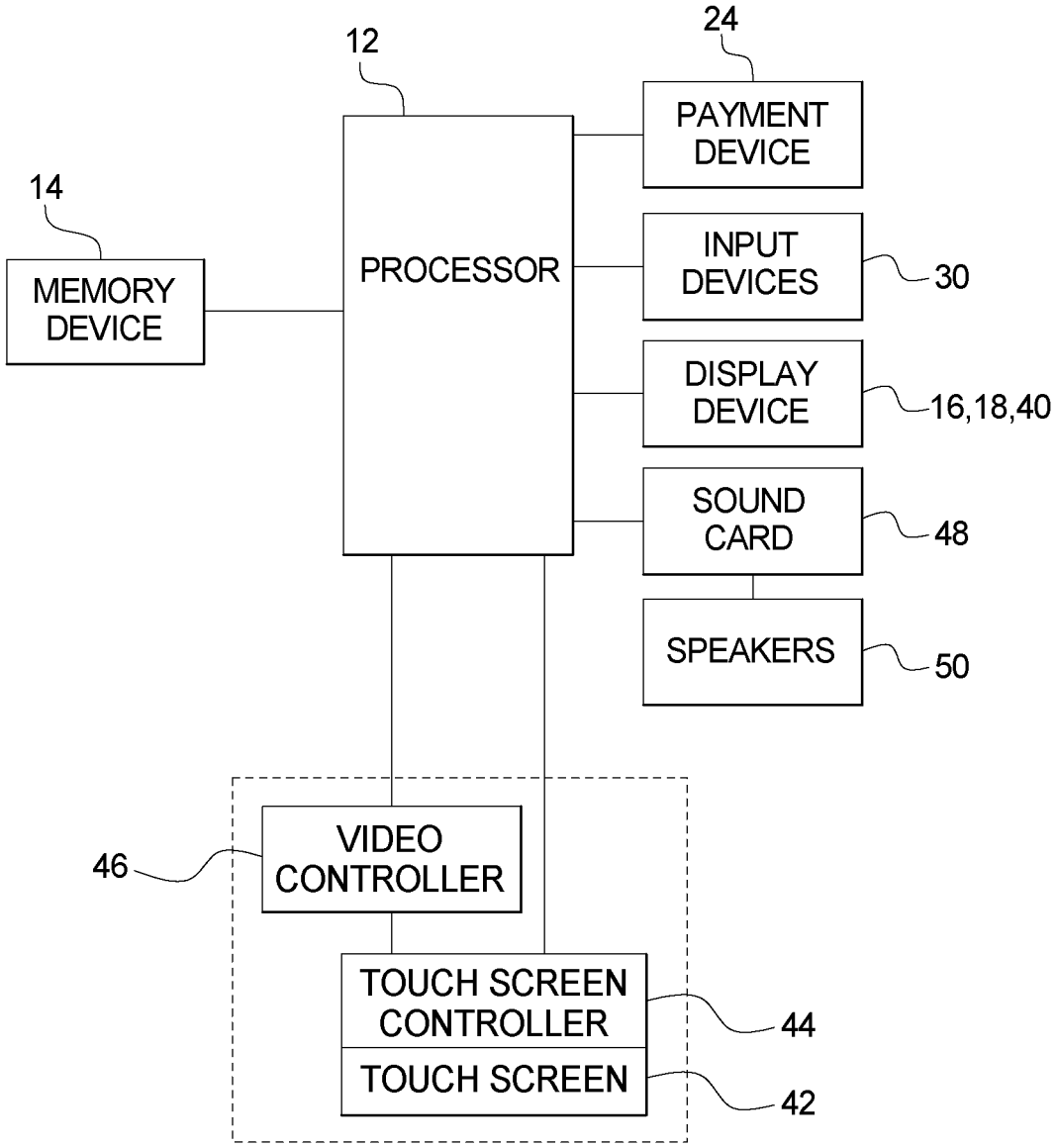
FIG. 2A is a schematic block diagram of one embodiment of an electronic configuration for one of the gaming devices disclosed herein.

In one embodiment, as illustrated in FIG. 2A, the gaming device may include at least one processor 12, such as a microprocessor, a microcontroller-based platform, a suitable integrated circuit or one or more application-specific integrated circuits ("ASIC's"). The processor may be in communication with or operable to access or to exchange signals with at least one data storage or memory device 14. In one embodiment, the processor and the memory device reside within the cabinet of the gaming device. The memory device may store program code and instructions, executable by the processor, to control the gaming device. The memory device also may store other data such as image data, event data, player input data, random or pseudo-random number generators, paytable data or information, and applicable game rules that relate to the play of the gaming device. In one embodiment, the memory device may include random access memory ("RAM"), which may include non-volatile RAM ("NVRAM"), magnetic RAM ("MRAM"), ferroelectric RAM ("FeRAM"), and other forms as commonly understood in the gaming industry. In one embodiment, the memory device may include read only memory ("ROM"). In one embodiment, the memory device may include flash memory and/or electrically erasable programmable read only memory ("EEPROM"). Any other suitable magnetic, optical, and/or semiconductor memory may operate in conjunction with the gaming device disclosed herein.

In one embodiment, part or all of the program code and/or operating data described above may be stored in a detachable or removable memory device, including, but not limited to, a suitable cartridge, disk, CD ROM, DVD, or USB memory device. In other embodiments, part or all of the program code and/or operating data described above may be downloaded to the memory device through a suitable network.

In one embodiment, an operator or a player may use such a removable memory device in a desktop computer, a laptop computer, a hand-held device, such as a personal digital assistant ("PDA"), a portable computing or mobile device, or another computerized platform to implement the present disclosure. In one embodiment, the gaming device or gaming machine disclosed herein may be operable over a wireless network, for example as part of a wireless gaming system. In one such embodiment, the gaming machine may be a hand-held device, a mobile device, or any other suitable wireless device that may enable a player to play any suitable game at a variety of different locations. In various embodiments in which the gaming device or gaming machine may be a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It may be appreciated that a gaming device or gaming machine as disclosed herein may be a device that may have obtained approval from a regulatory gaming commission or a device that may have not obtained approval from a regulatory gaming commission. It may be appreciated that the processor and memory device may be collectively referred to herein as a "computer" or "controller."

In one embodiment, as discussed in more detail below, the gaming device may randomly generate awards and/or other game outcomes based on probability data. In one such embodiment, this random determination may be provided through utilization of a random number generator ("RNG"), such as a true random number generator, a pseudo random number generator, or other suitable randomization process. In one embodiment, each award or other game outcome may be associated with a probability and the gaming device may generate the award or other game outcome to be provided to the player based on the associated probabilities. In this embodiment, since the gaming device may generate outcomes randomly or based upon one or more probability calculations, there is no certainty that the gaming device may ever provide the player with any specific award or other game outcome.

In another embodiment, as discussed in more detail below, the gaming device may employ a predetermined or finite set or pool of awards or other game outcomes. In this embodiment, as each award or other game outcome may be provided to the player, the gaming device may flag or remove the provided award or other game outcome from the predetermined set or pool. Once flagged or removed from the set or pool, the specific provided award or other game outcome from that specific pool cannot be provided to the player again. This type of gaming device may provide players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server may call the bingo balls that result in a specific bingo game outcome. The resultant game outcome may be communicated to the individual gaming device to be provided to a player. In one embodiment, this bingo outcome may be displayed to the player as a bingo game and/or in any form in accordance with the present disclosure.

In one embodiment, as illustrated in FIG. 2A, the gaming device may include one or more display devices controlled by the processor. The display devices may be connected to or mounted on the cabinet of the gaming device. The embodiment shown in FIG. 1A may include a central display device 16 which may display a primary game. This display device may also display any suitable secondary game associated with the primary game as well as information relating to the primary or secondary game. The alternative embodiment shown in FIG. 1B may include a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device may include a credit display 20 which may display a player's current number of credits, cash, account balance, or the equivalent. In one embodiment, the gaming device may include a bet display 22 which may display a player's amount wagered. In one embodiment, as described in more detail below, the gaming device may include a player tracking display 40 which may display information regarding a player's play tracking status.

In another embodiment, at least one display device may be a mobile display device, such as a PDA or tablet PC, that may enable play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device may include a touch-screen with an associated touch-screen controller. The display devices may be of any suitable size and configuration, such as a square, a rectangle or an elongated rectangle.

The display devices of the gaming device may be configured to display at least one or a plurality of game or other suitable images, symbols and indicia such as any visual representation or exhibition of the movement of objects such as mechanical, virtual, or video reels and wheels, dynamic lighting, video images, images of people, characters, may place, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device may include at least one payment device 24 in communication with the processor. As seen in FIGS. 1A and 1B, a payment device such as a payment acceptor may include a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card may be a smart card having a programmed microchip, a coded magnetic strip or coded rewritable magnetic strip, wherein the programmed microchip or magnetic strips may be coded with a player's identification, credit totals (or related data), and/or other relevant information. In another embodiment, a player may carry a portable device, such as a cell phone, a radio frequency identification tag, or any other suitable wireless device, which may communicate a player's identification, credit totals (or related data), and other relevant information to the gaming device. In one embodiment, money may be transferred to a gaming device through electronic funds transfer. When a player funds the gaming device, the processor may determine the amount of funds entered and may display the corresponding amount on the credit or other suitable display as described above.

As seen in FIGS. 1A, 1B, and 2A, in one embodiment the gaming device may include at least one or a plurality of input devices 30 in communication with the processor. The input devices may include any suitable device which may enable the player to produce an input signal which may be received by the processor. In one embodiment, after appropriate funding of the gaming device, the input device may be a game activation device, such as a play button 32 or a pull arm (not shown) which may be used by the player to start any primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device may be a bet one button. The player may place a bet by pushing the bet one button. The player may increase the bet by one credit each time the player pushes the bet one button. When the player pushes the bet one button, the number of credits shown in the credit display may decrease by one, and the number of credits shown in the bet display may increase by one. In another embodiment, one input device may be a bet max button (not shown) which may enable the player to bet the maximum wager permitted for a game of the gaming device.

In one embodiment, one input device may be a cash out button 34. The player may push the cash out button to receive a cash payment or other suitable form of payment corresponding to the number of remaining credits. In one embodiment, when the player cashes out, a payment device, such as a ticket, payment, or note generator 36 prints or otherwise may generate a ticket or credit slip to provide to the player. The player may receive the ticket or credit slip and may redeem the value associated with the ticket or credit slip via a cashier (or other suitable redemption system). In another embodiment, when the player cashes out, the player may receive the coins or tokens in a coin payout tray. It may be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device may be a touch-screen 42 coupled with a touch-screen controller 44 or some other touch-sensitive display overlay to allow for player interaction with the images on the display. The touch-screen and the touch-screen controller may be connected to a video controller 46. A player may make decisions and input signals into the gaming device by touching the touch-screen at the appropriate locations. One such input device may be a conventional touch-screen button panel.

The gaming device may further may include a plurality of communication ports for enabling communication of the processor with external peripherals, such as external video sources, expansion buses, game or other may display, a SCSI port, or a keypad.

In one embodiment, as seen in FIG. 2A, the gaming device may include a sound generating device controlled by one or more sounds cards 48 which function in conjunction with the processor. In one embodiment, the sound generating device may include at least one or a plurality of speakers 50 or other sound generating hardware and/or software for generating sounds, such as by playing music for the primary and/or secondary game or by playing music for other modes of the gaming device, such as an attract mode. In one embodiment, the gaming device may provide dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that may be selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

In one embodiment wherein the directional symbol evaluation game disclosed herein may be implemented as a bonus or secondary game, the gaming device 10 may incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment may produce a random outcome based on probability data at the time of or after placement of a wager. That is, different primary wagering games, such as video poker games, video blackjack games, video keno, video bingo or any other suitable primary or base game may be implemented. In one embodiment, the disclosed multi-dimensional cascading symbol game may be implemented as a base or primary game.

In one embodiment, as illustrated in FIGS. 1A and 1B, a base or primary game may be a slot game with one or more paylines 52. In this embodiment, the gaming device may include at least one or a plurality of reels 54, such as three to five reels 54, in either electromechanical form with mechanical rotating reels or video form with simulated reels and movement thereof. In one embodiment, an electromechanical slot machine may include a plurality of adjacent, rotatable reels which may be combined and operably coupled with an electronic display of any suitable type. In another embodiment, if the reels 54 are in video form, one or more of the display devices, as described above, may display the plurality of simulated video reels 54. Each reel 54 may display a plurality of indicia or symbols, such as bells, hearts, fruits, numbers, letters, bars, or other images which may correspond to a theme associated with the gaming device. In another embodiment, one or more of the reels may be independent reels or unisymbol reels. In this embodiment, each independent or unisymbol reel may generate and may display one symbol to the player.

In one embodiment, one or more of the paylines may be horizontal, vertical, circular, diagonal, angled or any combination thereof. In another embodiment, one or more of the paylines each may include a plurality of adjacent symbol display positions on a requisite number of adjacent reels. In one such embodiment, one or more paylines may be formed between at least two symbol display positions which may be adjacent to each other by either sharing a common side or sharing a common corner (i.e., such paylines may be connected paylines). In these embodiments, the gaming device may enable a player to wager on one or more of such paylines to activate such wagered on paylines.

In another embodiment wherein one or more paylines may be formed between at least two symbol display positions which may be adjacent to each other, the gaming device may enable a player to wager on and thus activate a plurality of symbol display positions. In this embodiment, one or more paylines which may be formed from a plurality of adjacent active symbol display positions on a requisite number of adjacent reels may be activated.

In one embodiment, the gaming device may award prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device may determine any outcome to provide to the player based on the number of associated symbols which may be generated in active symbol display positions on the requisite number of adjacent reels (i.e., not on paylines passing through any displayed winning symbol combinations). In this embodiment, if a winning symbol combination is generated on the reels, the gaming device may provide the player one award for that occurrence of the generated winning symbol combination. For example, if one winning symbol combination is generated on the reels, the gaming device may provide a single award to the player for that winning symbol combination (i.e., not based on the number of paylines that would have passed through that winning symbol combination). It may be appreciated that a gaming device that may enable wagering on ways to win may provide the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win may be determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It may be appreciated that modifying the number of generated symbols by either modifying the number of reels or modifying the number of symbols generated in active symbol display positions by one or more of the reels modifies the number of ways to win.

In another embodiment, the gaming device may enable a player to wager on and thus activate symbol display positions. In one such embodiment, the symbol display positions may be on the reels. In this embodiment, if based on the player's wager, a reel is activated, then each of the symbol display positions of that reel may be activated and each of the active symbol display positions may be part of one or more of the ways to win. In one embodiment, if based on the player's wager, a reel is not activated, then a designated number of default symbol display positions, such as a single symbol display position of the middle row of the reel, may be activated and the default symbol display position(s) may be part of one or more of the ways to win. This type of gaming machine may enable a player to wager on one, more than one or all of the reels and the processor of the gaming device uses the number of wagered on reels to determine the active symbol display positions and the number of possible ways to win. In alternative embodiments, (1) no symbols may be displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position may be activated on each of the remaining four reels. In this example, as described above, the gaming device may provide the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position may be activated on each of the remaining two reels. In this example, as described above, the gaming device may provide the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually may determine if a symbol generated in an active symbol display position on a first reel may form part of a winning symbol combination with or is otherwise suitably related to a symbol generated in an active symbol display position on a second reel. In this embodiment, the gaming device classifies each pair of symbols which form part of a winning symbol combination (i.e., each pair of related symbols) as a string of related symbols. For example, if active symbol display positions may include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device may determine if any of the symbols from the next adjacent reel may be added to any of the formed strings of related symbols. In this embodiment, for a first of the classified strings of related symbols, the gaming device may determine if any of the symbols generated by the next adjacent reel form part of a winning symbol combination or are otherwise related to the symbols of the first string of related symbols. If the gaming device determines that a symbol generated on the next adjacent reel may be related to the symbols of the first string of related symbols, that symbol may be subsequently added to the first string of related symbols. For example, if the first string of related symbols is the string of related cherry symbols and a related cherry symbol is generated in the middle row of the third reel, the gaming device may add the related cherry symbol generated on the third reel to the previously classified string of cherry symbols.

On the other hand, if the gaming device determines that no symbols generated on the next adjacent reel are related to the symbols of the first string of related symbols, the gaming device may mark or flag such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device may proceed as described above for each of the remaining classified strings of related symbols which were previously classified or formed from related symbols on the first and second reels.

After analyzing each of the remaining strings of related symbols, the gaming device may determine, for each remaining pending or incomplete string of related symbols, if any of the symbols from the next adjacent reel, if any, may be added to any of the previously classified strings of related symbols. This process may continue until either each string of related symbols is complete or there are no more adjacent reels of symbols to analyze. In this embodiment, where there are no more adjacent reels of symbols to analyze, the gaming device may mark each of the remaining pending strings of related symbols as complete.

When each of the strings of related symbols is marked complete, the gaming device compares each of the strings of related symbols to an appropriate paytable and may provide the player any award associated with each of the completed strings of symbols. It may be appreciated that the player may be provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device may enable the player to play a conventional game of video draw poker and may initially deal five cards all face up from a virtual deck of fifty-two cards. Cards may be dealt as in a traditional game of cards or in the case of the gaming device, the cards may be randomly selected from a predetermined number of cards. If the player wishes to draw, the player may select the cards to hold via one or more input devices, such as by pressing related hold buttons or via the touch screen. The player then presses the deal button and the unwanted or discarded cards may be removed from the display and the gaming machine may deal the replacement cards from the remaining cards in the deck. This may result in a final five-card hand. The gaming device may compare the final five-card hand to a payout table which may utilize conventional poker hand rankings to determine the winning hands. The gaming device may provide the player with an award based on a winning hand and the number of credits the player wagered.

In another embodiment, the base or primary game may be a multi-hand version of video poker. In this embodiment, the gaming device may deal the player at least two hands of cards. In one such embodiment, the cards may be the same cards. In one embodiment each hand of cards may be associated with its own deck of cards. The player may choose the cards to hold in a primary hand. The held cards in the primary hand may be also held in the other hands of cards. The remaining non-held cards may be removed from each hand displayed and for each hand replacement cards may be randomly dealt into that hand. Since the replacement cards may be randomly dealt independently for each hand, the replacement cards for each hand may be different. The poker hand rankings may be then determined hand by hand against a payout table and awards may be provided to the player.

In one embodiment, a base or primary game may be a keno game wherein the gaming device may display a plurality of selectable indicia or numbers on at least one of the display devices. In this embodiment, the player may select at least one bit potentially a plurality of the selectable indicia or numbers via an input device such as a touch screen. The gaming device then may display a series of drawn numbers and determine an amount of matches, if any, between the player's selected numbers and the gaming device's drawn numbers. The player may be provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. In one embodiment, the disclosed multi-dimensional cascading symbol game may be implemented as a bonus or secondary game. The bonus or secondary game may enable the player to obtain a prize or payout in addition to the prize or payout, if any, obtained from the base or primary game. In general, a bonus or secondary game may produce a significantly higher level of player excitement than the base or primary game because it may provide a greater expectation of winning than the base or primary game, and may be accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may occur based on exceeding a certain amount of game play (such as number of games, number of credits, amount of time), or reaching a specified number of points earned during game play.

In one embodiment wherein the directional symbol evaluation game disclosed herein may be implemented as a primary or base game, the gaming device processor 12 or central controller 56 randomly may provide the player one or more plays of one or more secondary games. In one such embodiment, the gaming device may not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device may include a program which may automatically begin a bonus round after the player may have achieved a triggering event or qualifying condition in the base or primary game. In another embodiment, after a player may have qualified for a bonus game, the player may subsequently enhance his/her bonus game participation through continued play on the base or primary game. Thus, for each bonus qualifying event, such as a bonus symbol, that the player may obtain, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game may be needed. That is, a player may not purchase entry into a bonus game; rather they must win or earn entry through play of the primary game, thus encouraging play of the primary game. In another embodiment, qualification of the bonus or secondary game may be accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
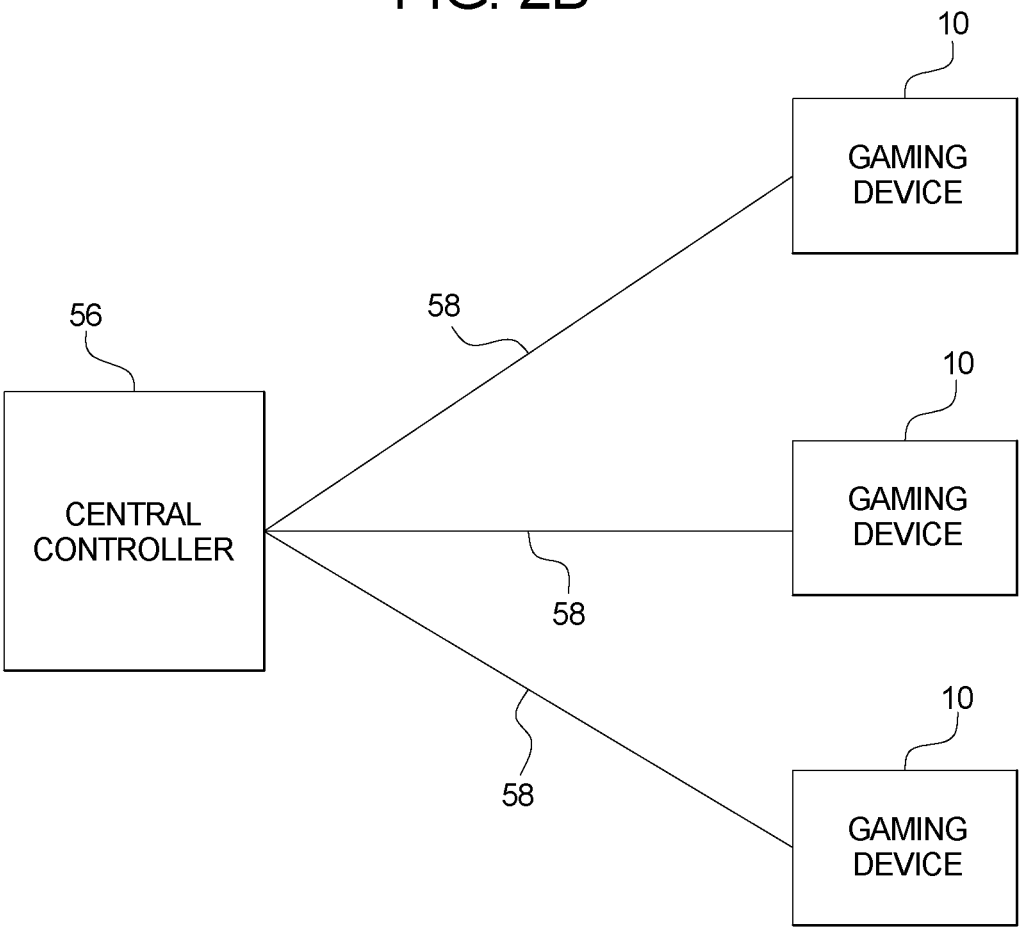
FIG. 2B is a schematic block diagram of one embodiment of a network configuration for a plurality of gaming devices disclosed herein.

In one embodiment, as illustrated in FIG. 2B, one or more of the gaming devices 10 may be in communication with each other and/or at least one central controller 56 through a data network or remote communication link 58. In this embodiment, the central server, central controller or remote host may be any suitable server or computing device which may include at least one processor and at least one memory or storage device. In different such embodiments, the central server may be a progressive controller or a processor of one of the gaming devices in the gaming system. In these embodiments, the processor of each gaming device may be designed to transmit and receive events, messages, commands, or any other suitable data or signal between the individual gaming device and the central server. The gaming device processor may be operable to execute such communicated events, messages, or commands in conjunction with the operation of the gaming device. Moreover, the processor of the central server may be designed to transmit and receive events, messages, commands, or any other suitable data or signal between the central server and each of the individual gaming devices. The central server processor may be operable to execute such communicated events, messages, or commands in conjunction with the operation of the central server. It may be appreciated that one, more or each of the functions of the central controller, central server or remote host as disclosed herein may be performed by one or more gaming device processors. It may be further appreciated that one, more or each of the functions of one or more gaming device processors as disclosed herein may be performed by the central controller, central server or remote host.

In one embodiment, the game outcome provided to the player may be determined by a central server or controller and provided to the player at the gaming device. In this embodiment, each of a plurality of such gaming devices may be in communication with the central server or controller. Upon a player initiating game play at one of the gaming devices, the initiated gaming device may communicate a game outcome request to the central server or controller.

In one embodiment, the central server or controller may receive the game outcome request and may randomly generate a game outcome for the primary game based on probability data. In another embodiment, the central server or controller may randomly generate a game outcome for the secondary game based on probability data. In another embodiment, the central server or controller may randomly generate a game outcome for both the primary game and the secondary game based on probability data. In this embodiment, the central server or controller may be capable of storing and utilizing program code or other data similar to the processor and memory device of the gaming device.

In an alternative embodiment, the central server or controller maintains one or more predetermined pools or sets of predetermined game outcomes. In this embodiment, the central server or controller may receive the game outcome request and independently select a predetermined game outcome from a set or pool of game outcomes. The central server or controller may flag or mark the selected game outcome as used. Once a game outcome is flagged as used, it may be prevented from further selection from the set or pool and cannot be selected by the central controller or server upon another wager. The provided game outcome may include a primary game outcome, a secondary game outcome, primary and secondary game outcomes, or a series of game outcomes such as free games.

The central server or controller may communicate the generated or selected game outcome to the initiated gaming device. The gaming device may receive the generated or selected game outcome and may provide the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value may be determined for each of a plurality of linked or networked gaming devices based on the results of a bingo, keno, or lottery game. In this embodiment, each individual gaming device may utilize one or more bingo, keno, or lottery games to determine the predetermined game outcome value provided to the player for the interactive game played at that gaming device. In one embodiment, the bingo, keno, or lottery game may be displayed to the player. In another embodiment, the bingo, keno or lottery game may not be displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device may be provided or associated with a different bingo card. Each bingo card may consist of a matrix or array of elements, wherein each element may be designated with a separate indicia, such as a number. It may be appreciated that each different bingo card may include a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller may randomly select or draw, one at a time, a plurality of the elements. As each element is selected, a determination may be made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card may be marked or flagged. This process of selecting elements and marking any selected elements on the provided bingo cards may continue until one or more predetermined patterns are marked on one or more of the provided bingo cards. It may be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome may be determined for each of the enrolled gaming devices based, at least in part, on the selected elements on the provided bingo cards. As described above, the game outcome determined for each gaming device enrolled in the bingo game may be utilized by that gaming device to determine the predetermined game outcome provided to the player. For example, a first gaming device to have selected elements marked in a predetermined pattern may be provided a first outcome of win $10 which may be provided to a first player regardless of how the first player plays in a first game, and a second gaming device to have selected elements marked in a different predetermined pattern may be provided a second outcome of win $2 which may be provided to a second player regardless of how the second player plays a second game. It may be appreciated that as the process of marking selected elements may continue until one or more predetermined patterns are marked, this embodiment ensures that at least one bingo card may win the bingo game and thus at least one enrolled gaming device may provide a predetermined winning game outcome to a player. It may be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern may be provided to the player as part of the predetermined game outcome. For example, if the four corners of a bingo card are marked within the first twenty selected elements, a supplemental award of $10 may be provided to the player as part of the predetermined game outcome. It may be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices may be in communication with a central server or controller for monitoring purposes only. That is, each individual gaming device may randomly generate the game outcomes to be provided to the player and the central server or controller monitors the activities and events occurring on the plurality of gaming devices. In one embodiment, the gaming network may include a real-time or on-line accounting and gaming information system operably coupled to the central server or controller. The accounting and gaming information system of this embodiment may include a player database for storing player profiles, a player tracking module for tracking players and a credit system for providing automated casino transactions.

In one embodiment, the gaming device disclosed herein may be associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system may track any player's gaming activity at the gaming device. In one such embodiment, the gaming device may include at least one card reader 38 in communication with the processor. In this embodiment, a player may be issued a player identification card which may have an encoded player identification number that uniquely identifies the player. When a player inserts their playing tracking card into the card reader to begin a gaming session, the card reader reads the player identification number off the player tracking card to identify the player. The gaming device and/or associated player tracking system may timely track any suitable information or data relating to the identified player's gaming session. Directly or via the central controller, the gaming device processor may communicate such information to the player tracking system. The gaming device and/or associated player tracking system also may timely track when a player removes their player tracking card when concluding play for that gaming session. In another embodiment, rather than requiring a player to insert a player tracking card, the gaming device may utilize one or more portable devices carried by a player, such as a cell phone, a radio frequency identification tag or any other suitable wireless device to track when a player begins and ends a gaming session. In another embodiment, the gaming device may utilize any suitable biometric technology or ticket technology to track when a player begins and ends a gaming session.

During one or more gaming sessions, the gaming device and/or player tracking system may track any suitable information or data, such as any amounts wagered, average wager amounts, and/or the time at which these wagers may be placed. In different embodiments, for one or more players, the player tracking system may include the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system may be displayed on a player tracking display 40. In another embodiment, such tracked information and/or any suitable feature associated with the player tracking system may be displayed via one or more service windows (not shown) which may be displayed on the central display device and/or the upper display device.

In one embodiment, a plurality of the gaming devices may be capable of being connected together through a data network. In one embodiment, the data network may be a local area network (LAN), in which one or more of the gaming devices may be substantially proximate to each other and an on-site central server or controller as in, for example, a gaming establishment or a portion of a gaming establishment. In another embodiment, the data network may be a wide area network (WAN) in which one or more of the gaming devices may be in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network may be an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator may be available. The expansion in the number of computers and number and speed of internet connections in recent years increases opportunities for players to play from an ever-increasing number of remote sites. It may be appreciated that the enhanced bandwidth of digital wireless communications may render such technology suitable for some or all communications, particularly if such communications may be encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices may be in communication with a central server or controller. The central server or controller may be any suitable server or computing device which may include at least one processor and a memory or storage device. In alternative embodiments, the central server may be a progressive controller or another gaming machine in the gaming system. In one embodiment, the memory device of the central server may store different game programs and instructions, executable by a gaming device processor, to control the gaming device. Each executable game program may represent a different game or type of game which may be played on one or more of the gaming devices in the gaming system. Such different games may include the same or substantially the same game play with different pay tables. In different embodiments, the executable game program may be for a primary game, a secondary game or both. In another embodiment, the game program may be executable as a secondary game to be played simultaneous with the play of a primary game (which may be downloaded to or fixed on the gaming device) or vice versa.

In this embodiment, each gaming device may include at least one or more display devices and/or one or more input devices for interaction with a player. A local processor, such as the above-described gaming device processor or a processor of a local server, may be operable with the display device (s) and/or the input device(s) of one or more of the gaming devices.

In operation, the central controller may be operable to communicate one or more of the stored game programs to at least one local processor. In different embodiments, the stored game programs may be communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor may execute the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards.

In one embodiment, a progressive gaming system host site computer may be coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer may be maintained for the overall operation and control of the progressive gaming system. In this embodiment, a progressive gaming system host site computer may oversee the entire progressive gaming system and may be the master for computing all progressive jackpots. All participating gaming sites report to, and receive information from, the progressive gaming system host site computer. Each central server computer may be responsible for all data communication between the gaming device hardware and software and the progressive gaming system host site computer. In one embodiment, an individual gaming machine may trigger a progressive award win. In another embodiment, a central server (or the progressive gaming system host site computer) may determine when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win may be triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device may not provide any apparent reasons to the player for winning a progressive award, wherein winning the progressive award is not triggered by an event in or based specifically on any of the plays of any primary game. That is, a player may be provided a progressive award without any explanation or alternatively with simple explanations. In another embodiment, a player may be provided a progressive award at least partially based on a game triggered or symbol triggered event, such as at least partially based on the play of a primary game.

In one embodiment, one or more of the progressive awards may be each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player may place or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player may win one of the progressive awards. It may be appreciated that one or more of the progressive awards may each be funded, at least in part, based on the wagers placed on the primary games of the gaming machines in the gaming system, via a gaming establishment or via any suitable manner.

In another embodiment, one or more of the progressive awards may be partially funded via a side-bet or side-wager which the player may make (and which may be tracked via a side-bet meter). In one embodiment, one or more of the progressive awards may be funded with only side-bets or side-wagers placed. In another embodiment, one or more of the progressive awards may be funded based on player's wagers as described above as well as any side-bets or side-wagers placed.

In one alternative embodiment, a minimum wager level may be required for a gaming device to qualify to be selected to obtain one of the progressive awards. In one embodiment, this minimum wager level may be the maximum wager level for the primary game in the gaming machine. In another embodiment, no minimum wager level may be required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group may be shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Directional Symbol Game

Figure 3:
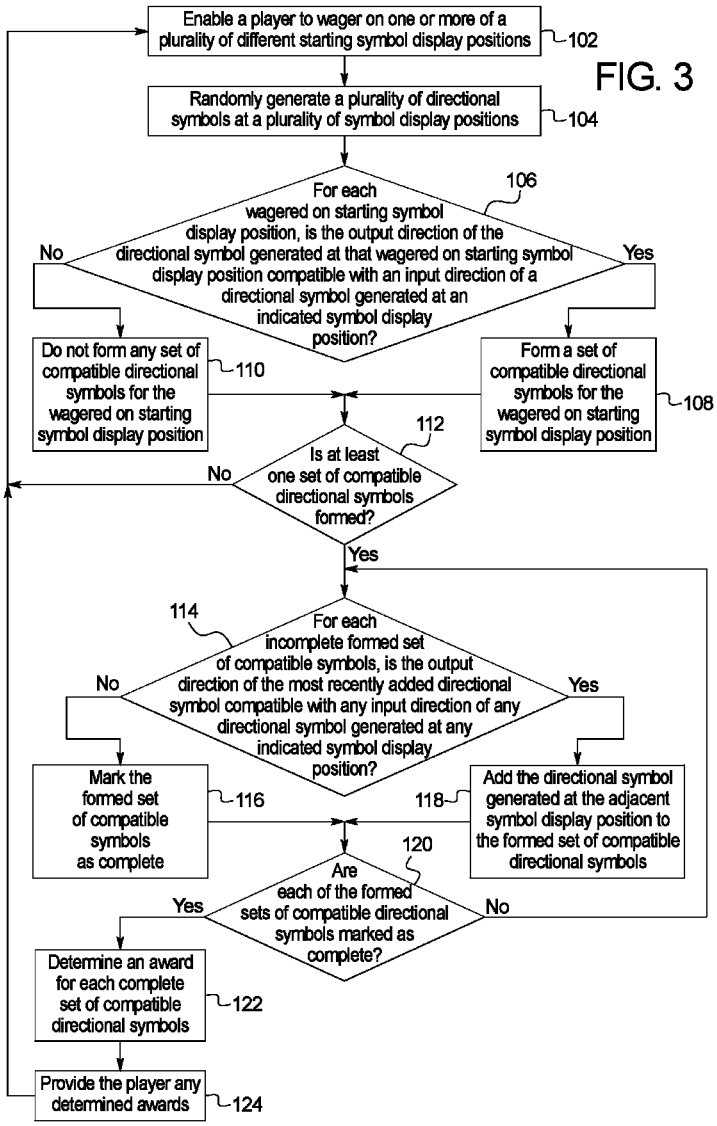
FIG. 3 is a flow chart of an example process of one embodiment of operating a gaming system including the directional symbol game disclosed herein.

Referring now to FIG. 3, a flowchart of an example embodiment of a process for operating a gaming system or a gaming device disclosed herein is illustrated. In one embodiment, this process may be embodied in one or more software programs stored in one or more memories and executed by one or more processors or servers. Although this process may be described with reference to the flowchart illustrated in FIG. 3, it may be appreciated that many other methods of performing the acts associated with this process may be used. For example, the order of certain steps described may be changed, or certain steps described may be optional. For instance, while the below described wagering on starting symbol display positions may be applicable if the directional symbol evaluation game disclosed herein may be implemented as a wagering game, such a wagering step may be omitted if the directional symbol evaluation game disclosed herein may be implemented as a non-wagering bonus or secondary game.

Figure 4A:
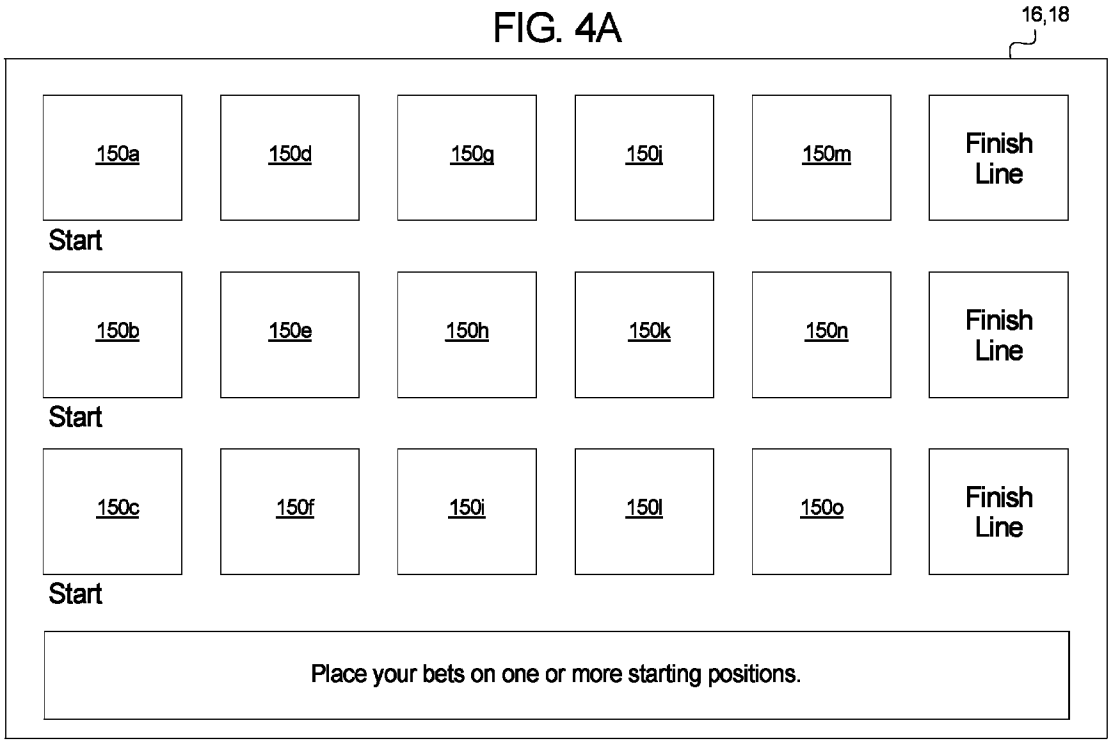
FIGS. 4A, 4B, 4C, 4D, 4E, 4F, 4G, 4H and 4I are front elevation views of an example display device of a gaming system illustrating a play of one embodiment of a directional symbol game disclosed herein.

As seen in FIG. 3, in one embodiment, the gaming system may enable a player to wager on one or more of a plurality of different starting symbol display positions as indicated in block 102. For example, as seen in FIG. 4A, the gaming system may enable the player to place a wager on each of three different staring symbol display positions 150*a*, 150*b* and 150*c*. In this illustrated example, the gaming system may provide appropriate messages such as "PLACE YOUR BETS ON ONE OR MORE STARTING POSITIONS" to the player visually, or through suitable audio or audiovisual displays.

Figure 4B:
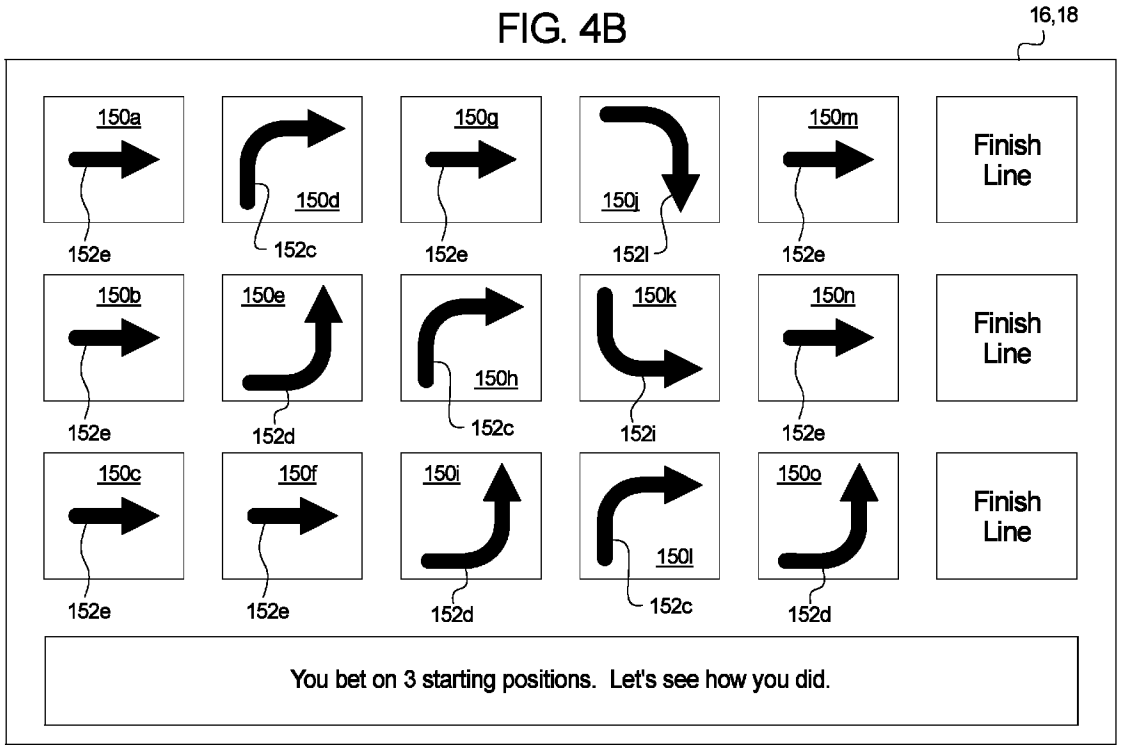

After the player wagers on one or more of the starting symbol display positions, the gaming system may randomly generate a plurality of directional symbols at a plurality of symbol display positions as indicated in block 104 of FIG. 3. In one such embodiment, the gaming system may cause a plurality of symbol generators, such as a plurality of reels, to each randomly generate one or more of a plurality of directional symbols. For example, as seen in FIG. 4B, the gaming system generates and displays a plurality of directional symbols 152 at a plurality of symbol display positions 150. In this illustrated example, the gaming system provides appropriate messages such as "YOU BET ON 3 STARTING POSITIONS" and "LET'S SEE HOW YOU DID" to the player visually, or through suitable audio or audiovisual displays.

In one embodiment, the plurality of directional symbols available to be generated each may include at least one of a plurality of different input directions. In the illustrated example of FIG. 5, each directional symbol has an input direction of: (i) up (as in directional symbols 152*g*, 152*h* and 152*i*), (ii) down (as in directional symbols 152*a*, 152*b* and 152*c*), (iii) left (as in directional symbols 152*d*, 152*e* and 152*f*) or (iv) right (as in directional symbols 152*j*, 152*k* and 152*l*).

In one embodiment, the plurality of directional symbols available to be generated each also may include at least one of a plurality of different output directions. In the illustrated example of FIG. 5, each directional symbol has an output direction of: (i) up (as in directional symbols 152*b*, 152*d* and 152*j*), (ii) down (as in directional symbols 152*f*, 152*h* and 152*l*), (iii) left (as in directional symbols 152*a*, 152*g* and 152*k*) or (iv) right (as in directional symbols 152*c*, 152*e* and 152*i*). In the illustrated example, each directional symbol is displayed as an arrow with the arrowhead indicating the output direction and the arrow foot (i.e., the end opposite of the arrow head) indicating the input direction.

Each input direction of each directional symbol may be compatible with or otherwise associated with at least one of the output directions of at least one of the other directional symbols. For example, the direction of up is compatible with or otherwise associated with the direction of down and the direction of down is likewise compatible with or otherwise associated with the direction of up. In this example, the direction of left is compatible with or otherwise associated with the direction of right and the direction of right is likewise compatible with or otherwise associated with the direction of left.

Each input direction of each directional symbol may be incompatible with or otherwise not associated with at least one of the output directions of at least one of the other directional symbols. For example, the directions of up and down are each incompatible with or otherwise not associated with the directions of left and right. In this example, the directions of left and right are each likewise incompatible with or otherwise not associated with the directions of up and down.

Figure 5:
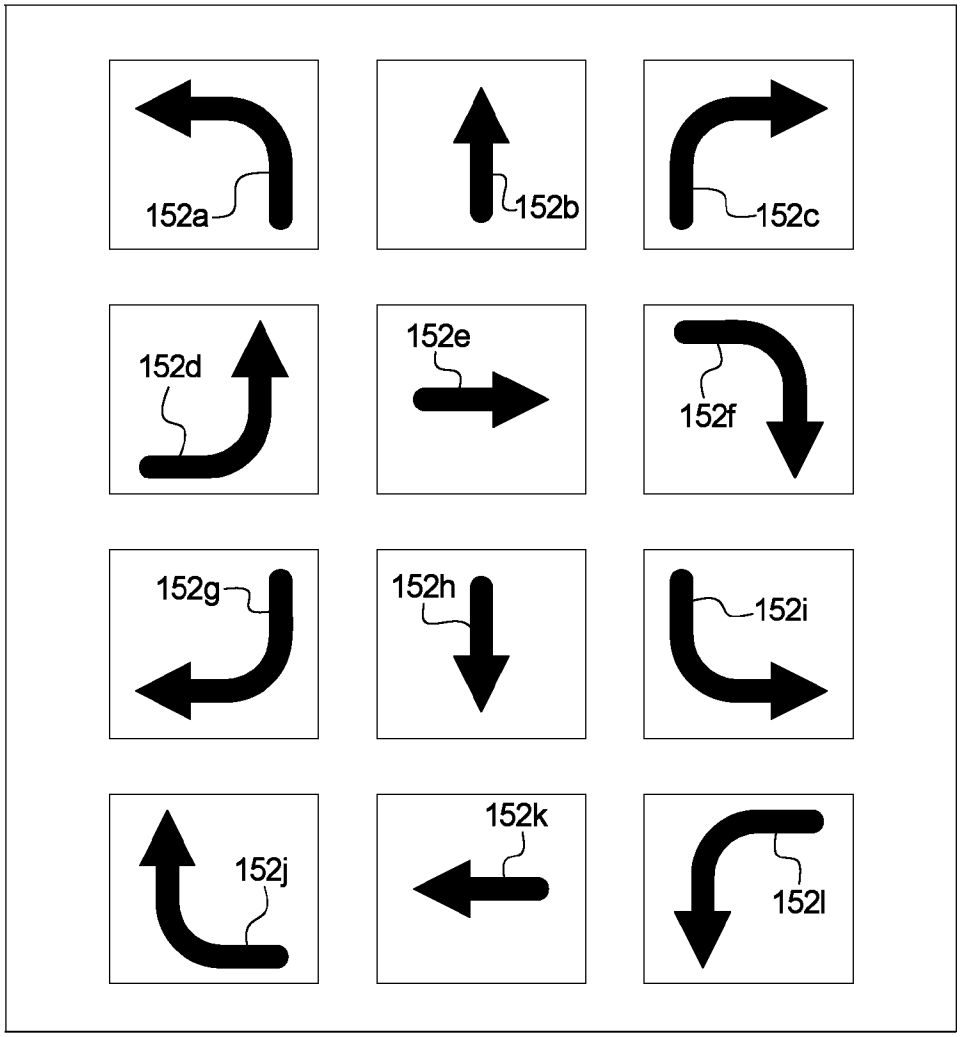
FIG. 5 is an example table illustrating a plurality of directional symbols available to be generated for a play of one embodiment of a directional symbol game disclosed herein.

In one embodiment, the combination of an input direction and an output direction for each directional symbol may cause each directional symbol to have a direction. For example, as seen in FIG. 5, the combination of an input direction of down and an output direction of right causes directional symbol 152*c* to have a direction which appears to turn right. In another example, as also seen in FIG. 5, the combination of an input direction of left and an output direction of down causes directional symbol 152*f* to have a direction which appears to turn down. In another example, as further seen in FIG. 5, the combination of an input direction of left and an output direction of right causes directional symbol 152*e* to have a direction which appears to move forward.

After randomly generating a plurality of directional symbols at a plurality of symbol display positions, for each wagered on starting symbol display position, the gaming system may determine whether the output direction of the directional symbol generated at that wagered on starting symbol display position is compatible with an input direction of a directional symbol generated at an indicated symbol display position as indicated in diamond 106 of FIG. 3. Put differently, the gaming system may determine whether the output direction of a generated directional symbol of a wagered on starting symbol display position indicates a compatible input direction of at least one directional symbol randomly generated in at least one symbol display position adjacent to the starting symbol display position.

Figure 4C:
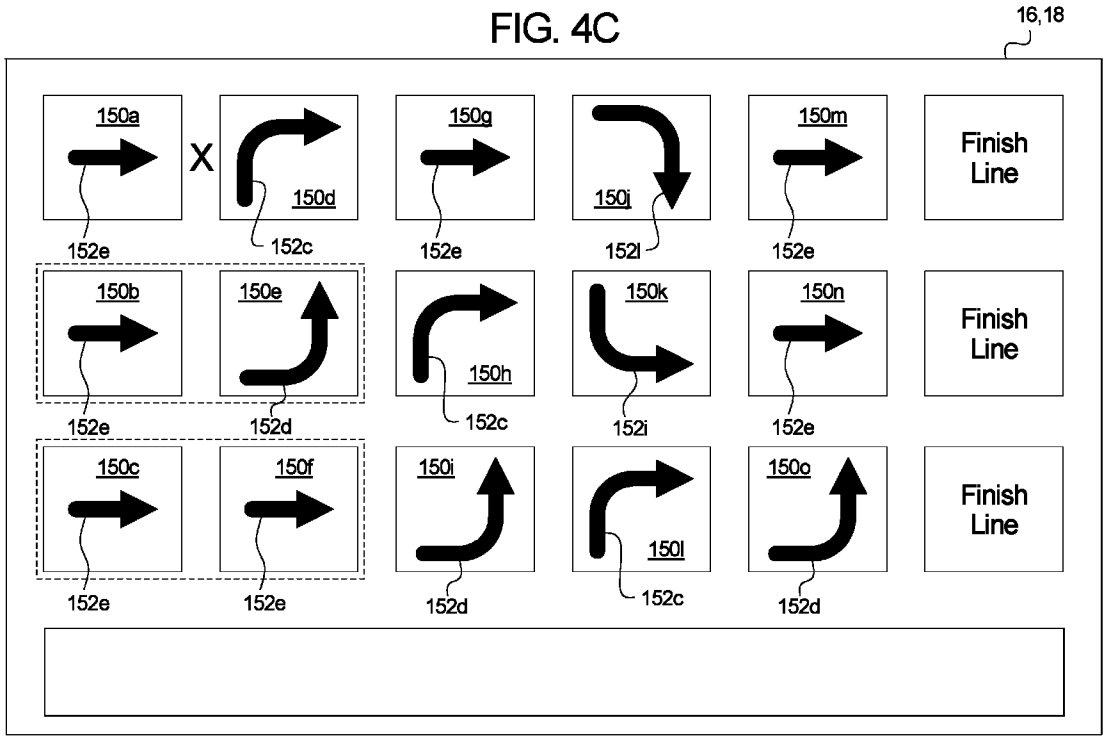

It may be appreciated that the gaming system may determine which input direction of which generated directional symbol is compatible or incompatible with which output direction of which generated directional symbol based on the direction of symbol evaluation (i.e., a left-to-right symbol evaluation or a right-to-left symbol evaluation) and which symbol display position the output direction of one of the generated directional symbols indicates. For example, as seen in FIG. 4C, the gaming system determines whether the input direction of the directional symbol generated at symbol display position 150*e* is compatible or incompatible with the output direction of directional symbol 152*e* generated at starting symbol display position 150*b* because symbol display position 150*e* is the symbol display position indicated by (i.e., pointed to) by directional symbol 152*e*. That is, the gaming system of this example does not determine whether the directional symbol generated at symbol display positions 150*d* or 150*f* are compatible or not compatible with the output direction of directional symbol 152*e* generated at starting symbol display position 150*b* because symbol display positions 150*e* and 150*f* are not indicated by (i.e., pointed to) by directional symbol 152*e*. Accordingly, the gaming system disclosed herein may utilize certain of the generated symbols to determine one or more others symbols at one or more other symbol display positions to be evaluated.

If the gaming system determines that an output direction of the directional symbol generated at a wagered on starting symbol display position is compatible with an input direction of at least one directional symbol indicated by that output direction, as indicated in block 108, the gaming system may form a set, chain or sequence of compatible directional symbols for that wagered on starting symbol display position.

For example, as seen in FIG. 4C, the gaming system may determine that the output direction of right of directional symbol 152*e* generated at starting symbol display position 150*b* is compatible with the input direction of left of indicated directional symbol 152*d* generated at indicated symbol display position 150*e*. In this example, the gaming system may form a set, chain or sequence of compatible directional symbols including generated directional symbol 152*e* of symbol display position 150*b* and generated directional symbol 152*d* of symbol display position 150*e*.

Similarly, as also seen in FIG. 4C, the gaming system determines that the output direction of right of directional symbol 152*e* generated at starting symbol display position 150*c* is compatible with the input direction of left of indicated directional symbol 152*e* generated at indicated symbol display position 150*f*. In this example, the gaming system forms a set, chain or sequence of compatible directional symbols including generated directional symbol 152*e* of symbol display position 150*c* and generated directional symbol 152*e* of symbol display position 150*f*.

If the gaming system determines that an output direction of the directional symbol generated at a wagered on starting symbol display position is incompatible with any input direction of any indicated directional symbol generated at any indicated symbol display position adjacent to the starting symbol display position, as indicated in block 110 of FIG. 3, the gaming system does not form any set of compatible directional symbols for that wagered on starting symbol display position. Rather, the gaming system may mark or flag the starting symbol display position as incompatible and complete. For example, as seen in FIG. 4C, the gaming system determines that the output direction of right of directional symbol 152*e* generated at starting symbol display position 150*a* is incompatible with the input direction of down of indicated directional symbol 152*c* generated at indicated symbol display position 150*d*. In this example, as illustrated by the "X" between the generated directional symbol 152*e* of symbol display position 150*a* and generated directional symbol 152*c* of symbol display position 150*d*, the gaming system does not form a set, chain or sequence of compatible directional symbols with generated directional symbol 152*e* of symbol display position 150*a* and generated directional symbol 152*c* of symbol display position 150*d*. Rather, the gaming system marks or flags starting symbol display position 150*a* as incompatible and complete.

After the formation of any sets of compatible directional symbols, the gaming system may determine if at least one set of compatible directional symbols is formed as indicated in diamond 112 of FIG. 3.

If no sets of compatible directional symbols are formed, the gaming system may return to block 102 and may enable the player to again wager on one or more of the plurality different starting symbol display positions.

On the other hand, if at least one set of compatible symbols is formed, as indicated in diamond 114 of FIG. 3, for each incomplete formed set of compatible symbols, the gaming system may determine whether the output direction of the most recently added directional symbol is compatible with any input direction of any directional symbol generated at any indicated symbol display positions. Put differently, the gaming system may determine whether the output direction of the most recently added directional symbol generated at a non-starting symbol display position indicates a compatible input direction of at least one directional symbol randomly generated in at least one symbol display position adjacent to that directional symbol.

For each incomplete formed set of compatible symbols, if the gaming system determines that an output direction of the most recently added directional symbol is incompatible with any input direction of any indicated directional symbol generated at any indicated symbol display position adjacent to that directional symbol, as indicated in block 116 of FIG. 3, the gaming system may mark or flag the formed set of compatible symbols as complete.

It may be appreciated that if the gaming system determines that no directional symbol is generated at any indicated symbol display position adjacent to the most recently added directional symbol, the gaming system may mark or flag the formed set of compatible symbols as complete. For example, if the output direction of the most recently added directional symbol indicates a final symbol display position, the gaming system marks or flags the formed set of compatible symbols as complete.

If may be further appreciated that if the gaming system determines that no symbol display positions are adjacent to the symbol display position of the most recently added directional symbol, the gaming system may mark or flag the formed set of compatible symbols as complete. For example, if the output direction of the most recently added directional symbol does not indicate any symbol display positions (i.e., the output direction of the most recently added directional symbol points off the symbol display position grid or matrix), the gaming system marks or flags the formed set of compatible symbols as complete.

For each incomplete formed set of compatible symbols, if the gaming system determines that an output direction of the most recently added directional symbol generated at a non-starting symbol display position is compatible with an input direction of a directional symbol indicated by that output direction, as indicated in block 118, the gaming system may add this directional symbol generated at the adjacent symbol display position to the formed set, chain or sequence of compatible directional symbols.

Figure 4D:
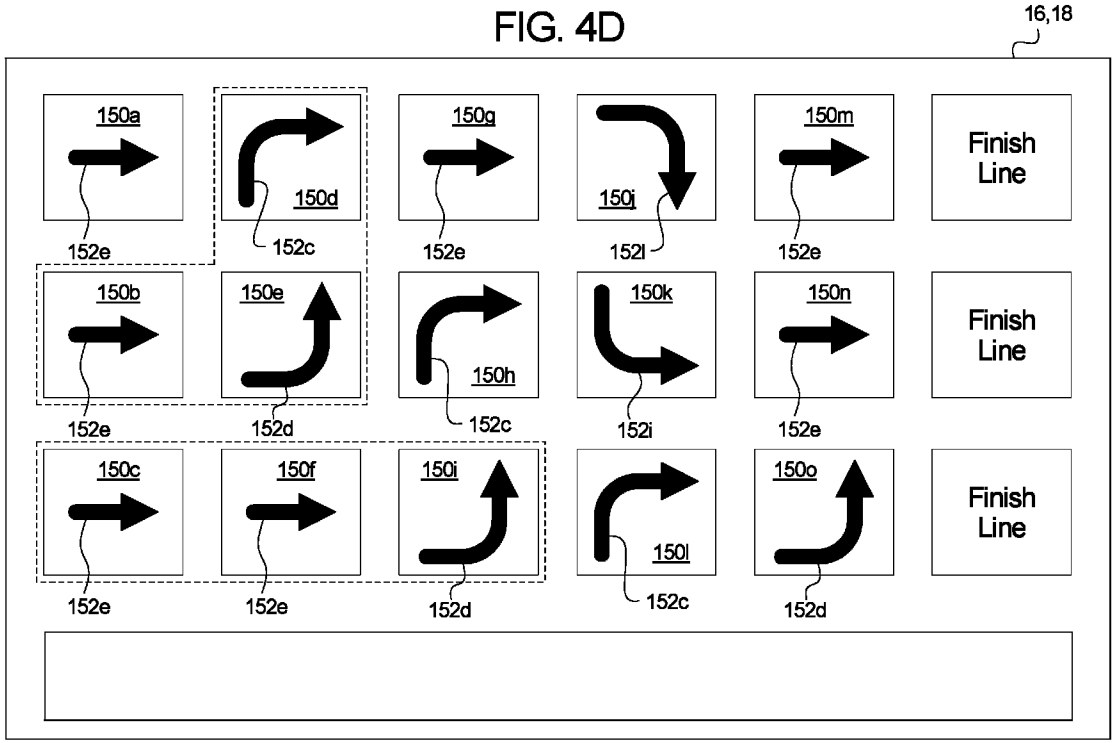
Figure 4E:
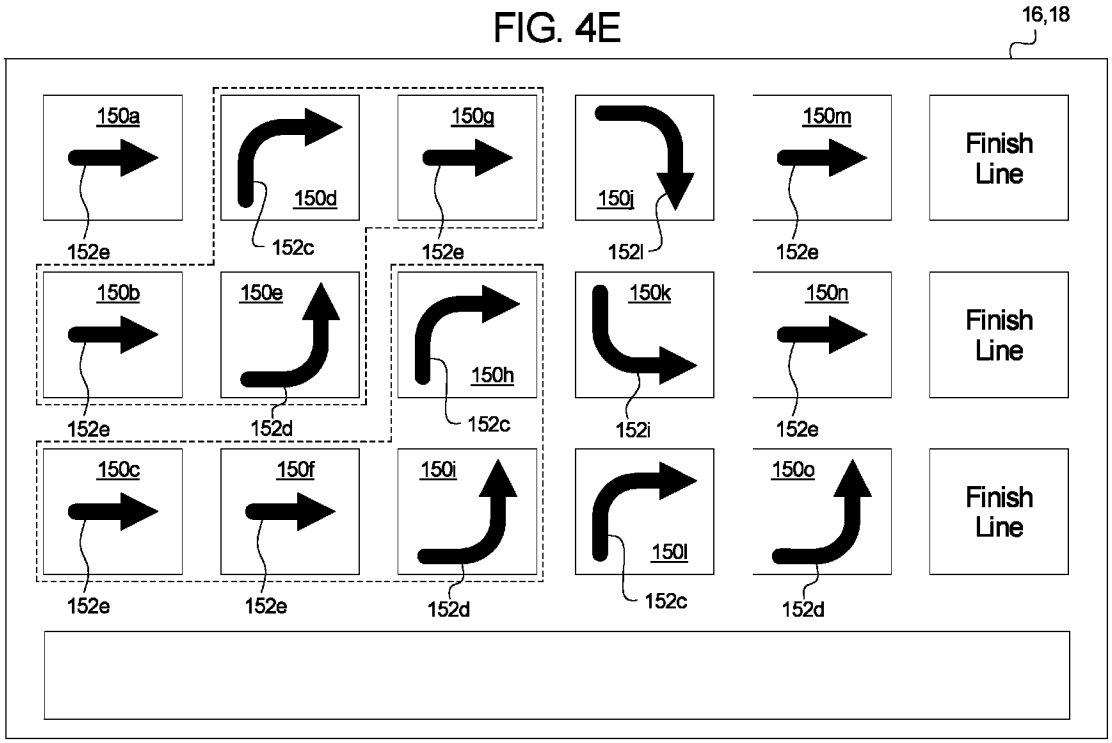
Figure 4F:
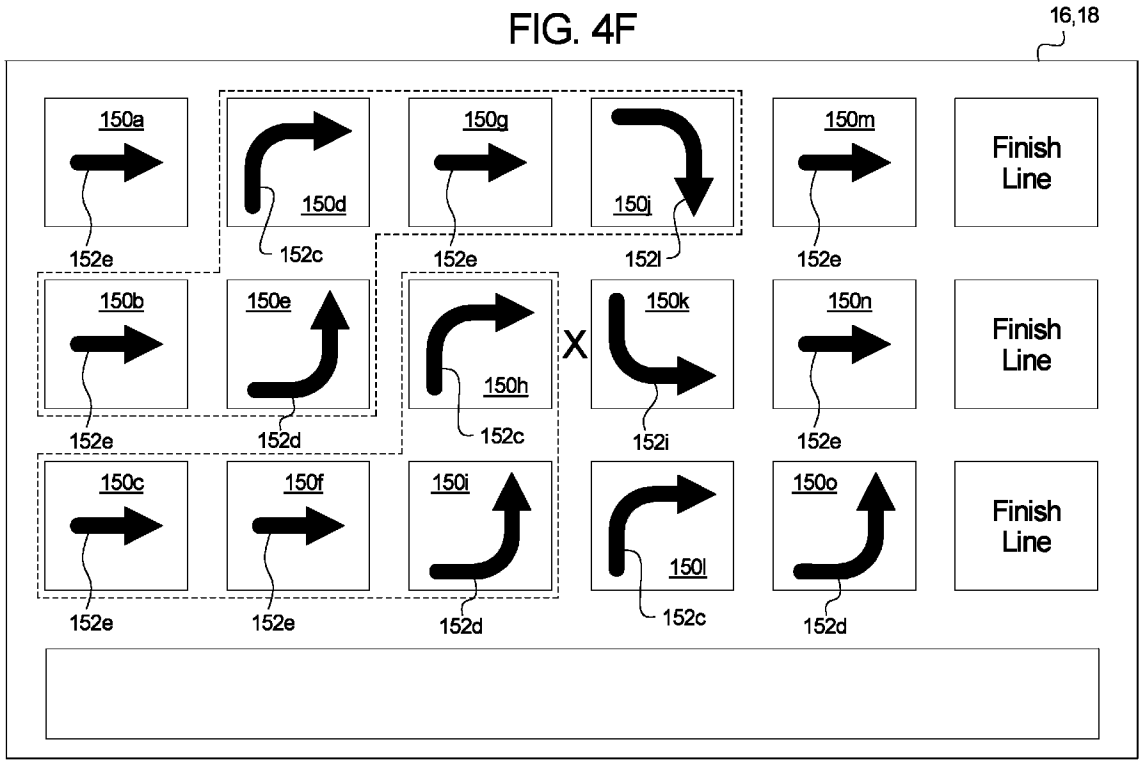
Figure 4G:
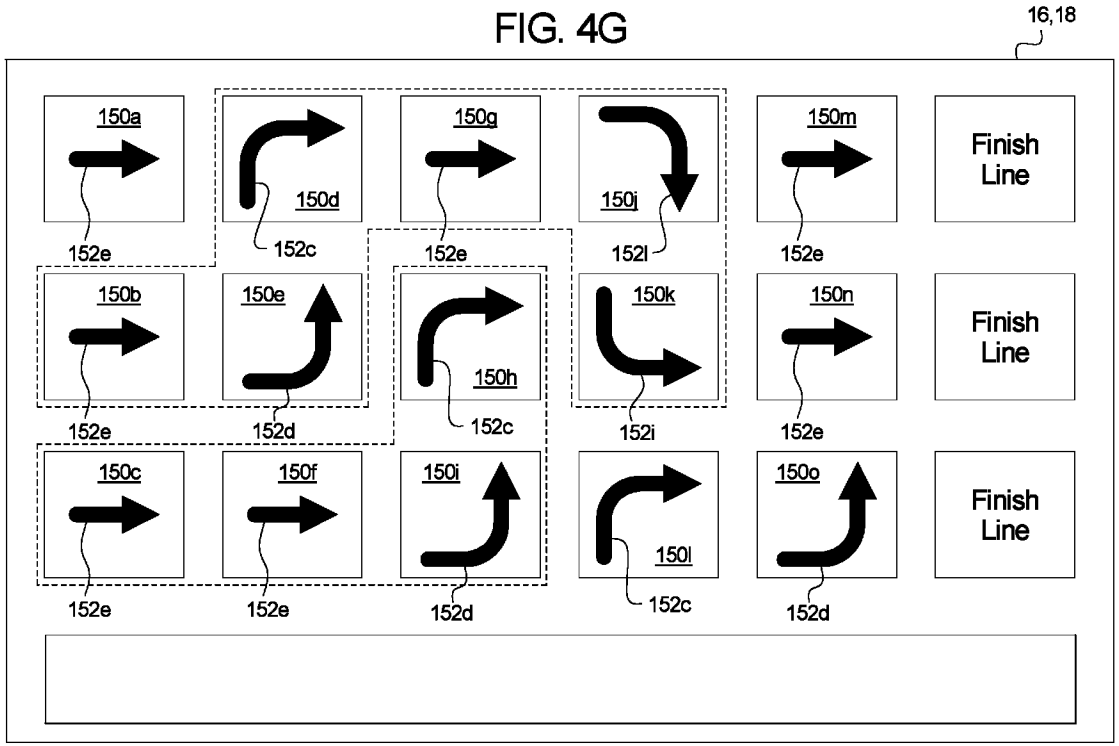
Figure 4H:
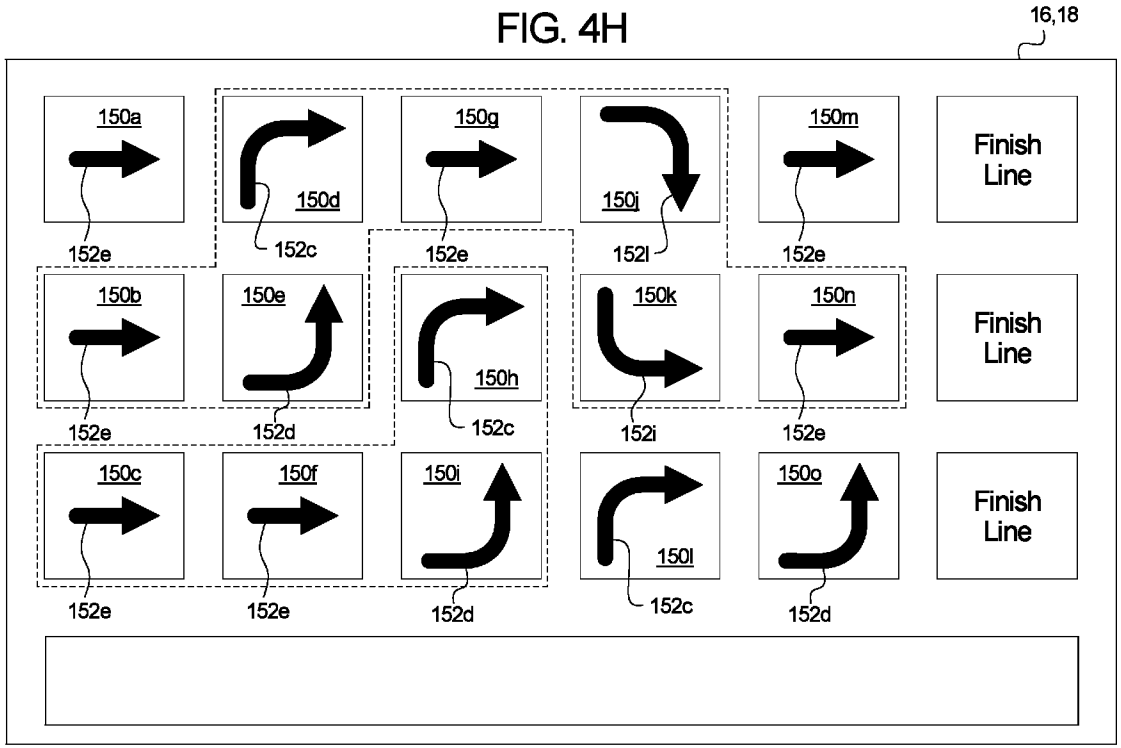
Figure 4I:
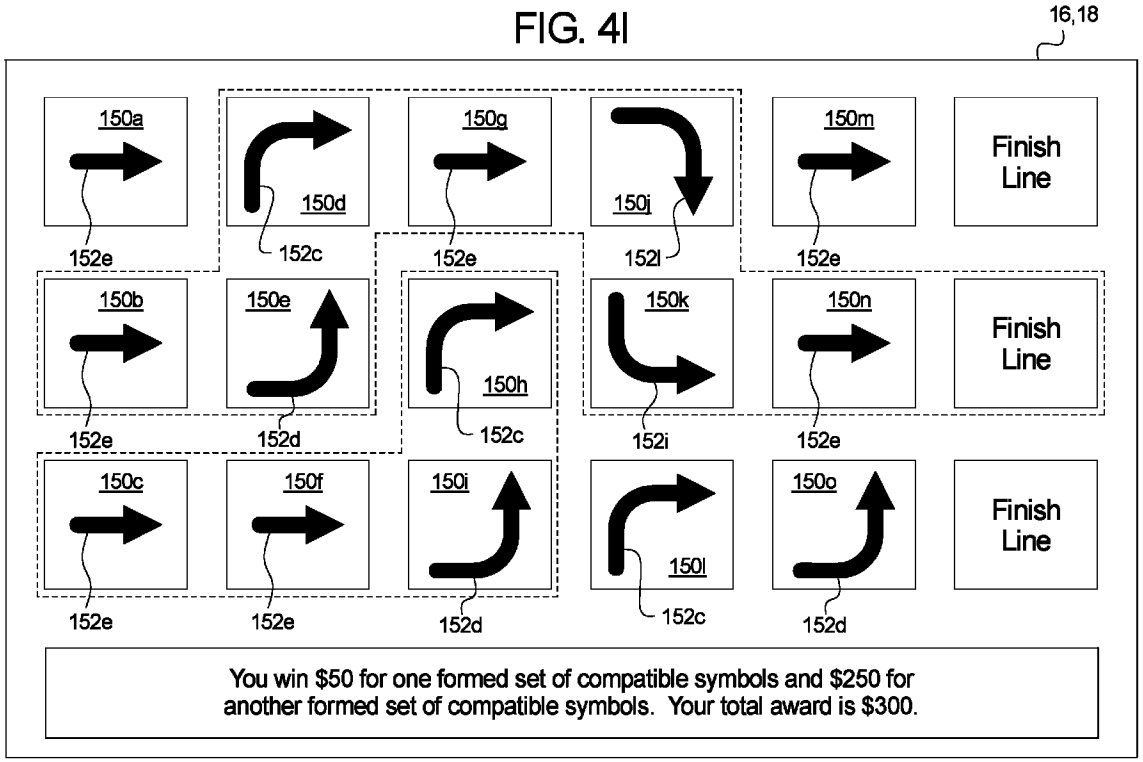

For example, as seen in FIG. 4D, the gaming system determines that the output direction of up of directional symbol 152*d* generated at symbol display position 150*e* is compatible with the input direction of down of indicated directional symbol 152*c* generated at indicated symbol display position 150*d*. In this example, the gaming system may add directional symbol 152*c* generated at indicated symbol display position 150*d* to the formed set of compatible directional symbols which already includes generated directional symbol 152*e* of symbol display position 150*b* and generated directional symbol 152*d* of symbol display position 150*e*.

In another example, as also seen in FIG. 4D, the gaming system determines that the output direction of right of directional symbol 152*e* generated at symbol display position 150*f* is compatible with the input direction of left of indicated directional symbol 152*d* generated at indicated symbol display position 150*i*. In this example, the gaming system may add directional symbol 152*c* generated at indicated symbol display position 150*i* to the formed set of compatible directional symbols which already includes generated directional symbol 152*e* of symbol display position 150*c* and generated directional symbol 152*e* of symbol display position 150*f*.

After adding zero, one or more compatible directional symbols to zero, one or more formed sets of compatible directional symbols and/or marking zero, one or more formed sets of compatible directional symbols as complete, the gaming system may determine if each of the formed sets of compatible directional symbols may be marked as complete as indicated in diamond 120 of FIG. 3.

If at least one formed set of compatible directional symbols has not been flagged as complete, the gaming system may return to diamond 114 and may proceed as described above with determining, for each incomplete formed set of compatible symbols, whether the output direction of the most recently added directional symbol is compatible with any input direction of any directional symbol generated at any indicated symbol display positions.

On the other hand, when the gaming system determines that each of the formed sets of compatible directional symbols is complete, the gaming system may determine an award for each complete set of compatible directional symbols as indicated in block 122.

In one embodiment, the gaming system may determine an award for a complete formed set of compatible directional symbols based on the quantity of compatible directional symbols in the set. In this embodiment, the greater the quantity of compatible directional symbols in a complete formed set, the greater the determined award. In another embodiment, the gaming system may determine an award for a complete formed set of compatible directional symbols based on the quantity of symbol generators or reels used to generated directional symbols of the set. In this embodiment, the greater the quantity of symbol generators or reels used to generate directional symbol of the complete formed set, the greater the determined award. In one embodiment, the gaming system may determine an award, such as an additional award or multiplier, for a complete formed set of compatible directional symbols based on if that formed set of compatible directional symbols reached a finish or destination position.

After determining an award for each complete formed set of compatible directional symbols, the gaming system may provide the player any determined awards as indicated in block 124 and may return to block 102 to enable the player to again wager on one or more of the plurality different starting symbol display positions.

For example, skipping ahead to FIG. 41, after: (i) determining that the output direction of right of directional symbol 152*c* generated at symbol display position 150*h* is incompatible with the input direction of up of directional symbol 152*i* generated at indicated symbol display position 150*k* (and thus marking the set of compatible directional symbols that started with starting position 150*c* as complete), and (ii) determining that no directional symbols remain to be indicated by the output direction of right of directional symbol 152*e* generated at symbol display position 150*n* (i.e., this formed set of compatible directional symbols reached a finish or destination position), the gaming system determines an award for each of these formed sets of compatible symbols. In this example, the gaming system determines an award of $50 for the formed set of four compatible directional symbols that started with starting position 150*c* and ended between directional symbol 152*c* generated at symbol display position 150*h* and directional symbol 152*i* generated at indicated symbol display position 150*k*. In this example, the gaming system also determines an award of $250 for the formed set of seven compatible directional symbols that started with starting position 150*c* and reached a destination position. In this illustrated example, the gaming system provides appropriate messages such as "YOU WIN $50 FOR ONE FORMED SET OF COMPATIBLE SYMBOLS AND $250 FOR ANOTHER FORMED SET OF COMPATIBLE SYMBOLS" and 'YOUR TOTAL AWARD IS $300" to the player visually, or through suitable audio or audiovisual displays.

In one embodiment, the gaming system may randomly generate each of the directional symbols at each of the symbol display positions. It may be appreciated that in this embodiment, the output direction of a directional symbol randomly generated at a starting symbol display position may not indicate a position that is part of the symbol display position matrix. For example, a directional symbol having an output direction of left which is randomly generated at one of the illustrated starting symbol display positions of FIG. 4A would indicate a position off of the symbol display matrix of a left-to-right evaluation and thus prevent any sets of compatible directional symbols from being formed from this starting symbol display position. In another embodiment, the gaming system may randomly generate the directional symbols at a plurality of the symbol display positions and may generate one or more predetermined symbols at one or more of the symbol display positions. In one such embodiment, as seen in FIG. 4A, the gaming system generates a predetermined directional symbol at each starting symbol display position such that the output direction of each directional symbol generated at each starting symbol display position indicates another symbol display position of the symbol display position matrix.

Figure 6:
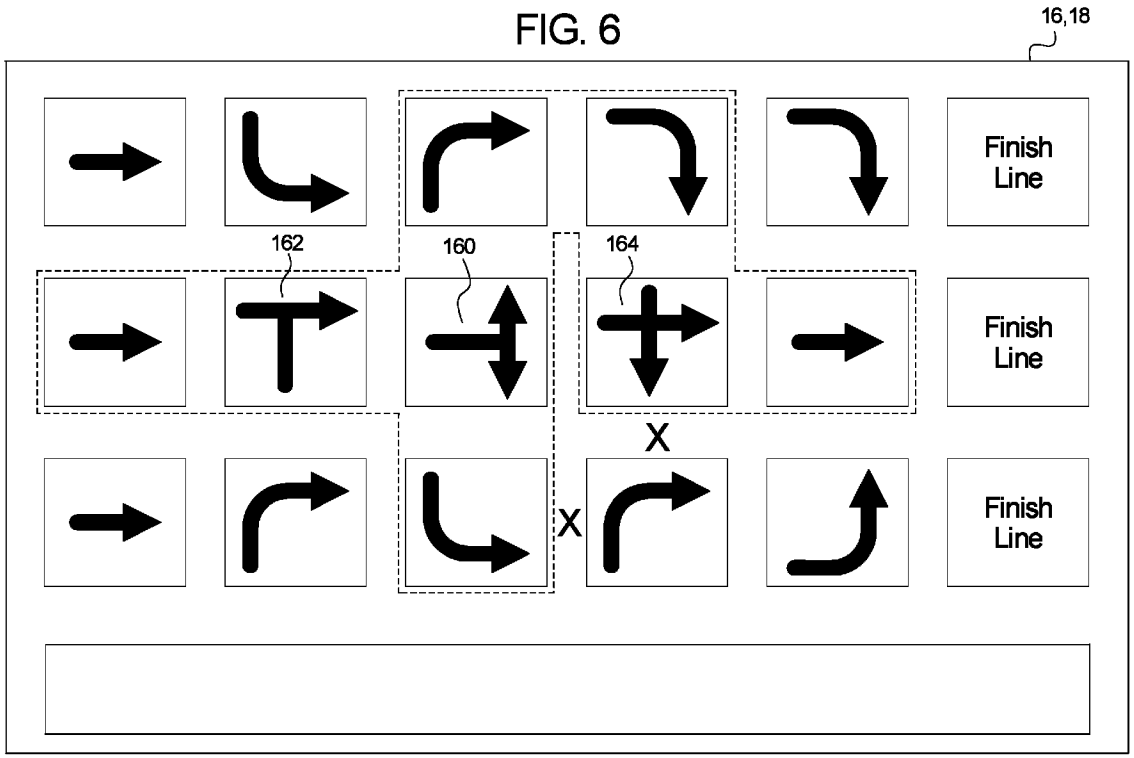
FIG. 6 is a front elevation view of an example display device of a gaming system illustrating a play of one embodiment of a directional symbol game including one or more multiple direction directional symbols disclosed herein.

In another embodiment, as seen in FIG. 6, one or more of the plurality of directional symbols 160 each may include a plurality of different output directions. Such a plurality of output directions enable a formed set of compatible directional symbols to branch off or be split into a plurality of sets of compatible directional symbols. For example, a directional symbol may include the output directions of down and left. In this example, dependent on the input directions of one or more directional symbols generated at one or more adjacent symbol display positions, this duel output directional symbol may cause one formed set of compatible directional symbols to continue in the downward direction and another formed set of compatible directional symbols (i.e., the split set) to continue in the left direction.

In another embodiment, as also seen in FIG. 6, one or more of the plurality of directional symbols 162 each may include a plurality of different input directions. Such a plurality of input directions enable a plurality of formed sets of compatible directional symbols to combine or otherwise be joined into one set of compatible directional symbols. For example, a directional symbol may include the input directions of down and left. In this example, dependent on the output directions of one or more directional symbols generated at one or more adjacent symbol display positions, this duel input directional symbol may cause one formed set of compatible directional symbols from the left and another formed set of compatible directional symbols from below to combine or merge into one formed set of compatible directional symbols.

In another embodiment, as further seen in FIG. 6, one or more of the plurality of directional symbols 164 each may include a plurality of different output directions and one or more of the plurality of directional symbols each may include a plurality of different input directions. In this embodiment, one or more directional symbols may both: (i) enable a formed set of compatible directional symbols to branch off or be split into a plurality of sets of compatible directional symbols, and (ii) enable a plurality of formed sets of compatible directional symbols to combine or otherwise be joined into one set of compatible directional symbols.

In another embodiment, one or more of the different input directions and/or the different output directions of the plurality of different directional symbols may each be associated with a characteristic, such as a color. In addition to determining if the output direction of one directional symbol is compatible with the input direction of another directional symbol at an adjacent symbol display position, the gaming system may determine if the characteristic of such input directions and output directions match or are otherwise compatible. In this embodiment, if the output direction of one directional symbol is compatible with the input direction of another directional symbol at an adjacent symbol display position, but the characteristics of such input direction and output direction do not match or are otherwise incompatible, these directional symbols may not be included in the same set of compatible symbols. For example, one directional symbol with a blue right output direction that indicates another directional symbol with a left red input direction are not compatible and are not part of the same set of compatible symbols. On the other hand, if the output directions of one directional symbol is compatible with the input direction of another directional symbol at an adjacent symbol display position and the characteristics of such input direction and output direction match or are otherwise compatible, these directional symbols may be included in the same set of compatible symbols. For example, one directional symbol with a blue right output direction that indicates another directional symbol with a left blue input direction are compatible and part of the same set of compatible symbols. It may be appreciated that such characteristics may be employed with one or more directional symbols including one input direction and one output direction, one or more directional symbols including a plurality of different output directions and/or one or more of the plurality of directional symbols including a plurality of different input directions.

In another embodiment, one or more directional symbols may be associated with a modifier such as multiplier. In one such embodiment, if a directional symbol associated with a modifier such as multiplier is included in a formed set of compatible directional symbols, the gaming system may multiply any award determined for that formed set of compatible directional symbols by the associated modifier such as multiplier. In another such embodiment, if a directional symbol associated with a modifier such as multiplier is included in a formed set of compatible directional symbols, the gaming system may count the directional symbol associated with the modifier such as multiplier as more than one compatible directional symbols. For example, if a formed set of four compatible directional symbols may include a directional symbol associated with a multiplier of three, the gaming system may evaluate this formed set of compatible directional symbols as if it included six compatible directional symbols (i.e., four generated compatible directional symbols and two additional compatible directional symbols attributed to the multiplier of three).

In another embodiment, one or more directional symbols may be associated with a static value. In this embodiment, if a directional symbol associated with a static value is included in a formed set of compatible directional symbols, the gaming system may add this static value to any award determined for that formed set of compatible directional symbols. In another embodiment, one or more starting display positions may be associated with a static value. In another embodiment, one or more positions may be associated with a static value. In another embodiment, one or more starting display positions may be associated with a static value and one or more destination positions may be associated with a static value. In these embodiments, if a formed set of compatible directional symbols includes a directional symbol generated at such a starting symbol display position and/or such a destination position (or if the formed set reaches the destination position), the gaming system may add such associated static values to any award determined for that formed set of compatible directional symbols.

In another embodiment, as seen in FIGS. 4A to 4I, each of the destination or finish positions (i.e., the illustrated "Finish Lines") may be an equal distance from each of the starting symbol display positions. In another embodiment, one or more of the destination or finish positions may be distributed throughout the symbol display position matrix. In one such embodiment, the destination positions further from the starting symbol display positions may be associated with greater awards than the destination positions closer to the starting symbol display positions.

In another embodiment, instead of randomly generating a plurality of directional symbols at a plurality of symbol display positions as described above, a directional symbol population algorithm may be used to generate one or more directional symbols at one or more symbol display positions. In this embodiment, the directional symbol population algorithm may start at a starting position and may add compatible directional symbols of randomly determined output directions to a set of compatible directional symbols until a destination position is reached or until a collision with another set of compatible directional symbols occurs. For example, the gaming system may display a snake of compatible directional symbols that grows in one or more random directions from a starting position. In one such embodiment, the gaming system may determine an award for each set of compatible directional symbols based on the quantity of compatible directional symbols add to a set before a destination position is reached or a collision with another set of compatible directional symbols occurs.

In one embodiment, a plurality of, but not all of, the directional symbols may be available to be generated for a play of the directional symbol game disclosed herein. In this embodiment, at least one of the directional symbols may be unavailable to be generated. For example, in one embodiment in which the gaming system may evaluate the generated symbols in a left-to-right configuration, the gaming system may not utilize (i.e., may not generate) the directional symbols of FIG. 5 that have an output direction of left (e.g., directional symbols 152*a*, 152*d* and 152*k*). In another embodiment, each of the directional symbols may be available to be generated for a play of the directional symbol game disclosed herein. For example, in the above described embodiment in which a set of compatible directional symbols grows until: (i) no directional symbols are generated in any indicated symbol display positions (i.e., a destination position is reached or a position off the symbol display position grid or matrix is indicated) or (ii) a collision with another set of compatible symbols may occur; the gaming system utilizes the directional symbols of FIG. 5 that have an output direction of left (e.g., directional symbols 152*a*, 152*d* and 152*k*).

In another embodiment, which directional symbol is generated at which symbol display position may be based, at least in part, on the location of the symbol display position. For example, if a directional symbol is generated on a left edge of a symbol display position matrix, the gaming system may be more likely to generate a directional symbol having an output direction of right than a directional symbol having an output direction of left. In one such embodiment, the gaming system may determine the directional symbol for a symbol display position based on a weighted table associated with that symbol display position. In another such embodiment, the gaming system may determine the directional symbols for a plurality of symbol display positions based on a weighted table associated with a particular subset of symbol display positions of the symbol display position matrix, such as based on a weighted table associated with a particular row, column, or other subset of symbol display positions of the symbol display position matrix.

In another embodiment, which directional symbol may be generated at which symbol display position may be based, at least in part, on one or more directional symbols displayed adjacent to that symbol display position. In one such embodiment, if a relatively high-value directional symbol is displayed adjacent to a symbol display position, a generated directional symbol may be relatively likely to have an output direction that indicates the high-value directional symbol.

In another embodiment, the gaming system may employ a respin or regeneration feature which may include randomly regenerating any directional symbols that may not be part of any formed sets of compatible directional symbols. In this embodiment, the gaming system retains one, more or each directional symbol that is part of a formed set of compatible directional symbols and removes one, more or each directional symbol that is not part of any formed sets of compatible directional symbols. For each removed directional symbol, the gaming system may randomly generate another directional symbol at the symbol display position of the removed directional symbol and then may determine whether such randomly generated directional symbols are compatible with any other directional symbols.

In another embodiment, the gaming system may enable a player to change one or more of the generated directional symbols. In one such embodiment, the gaming system may enable a player to rotate one or more generated directional symbols. Such rotation of a generated directional symbol changes the orientation of the rotated directional symbol (i.e., changes the orientation of the input direction and the output direction of the rotated directional symbol) and thus may change the compatibility of one or more generated directional symbols. In this embodiment, if the output direction of a first directional symbol is incompatible with the input direction of a second directional symbol generated at an indicated symbol display position, the gaming system may enable a player to rotate the first directional symbol and/or the second directional symbols to potentially cause the output direction of the first directional symbol to be compatible with the input direction of the second directional symbol generated at an indicated symbol display position.

In another such embodiment, the gaming system may enable a player to shift an entire row of generated symbols and/or an entire column of generated symbols. In another such embodiment, the gaming system may enable a player to swap the symbol display positions of two of more generated directional symbols. In another such embodiment, the gaming system may enable a player to save, hold or reserve a directional symbol (either from the beginning of the play of a game or from another game played) and selectively insert the saved directional symbol in one of the symbol display positions. It may be appreciated that in these embodiments any change of any directional symbols by the player may or may not change the compatibility of one or more generated directional symbols and thus may or may not change the quantity of sets of compatible directional symbols formed and/or the quantity of compatibility directional symbols in one or more formed sets of compatible directional symbols.

In one embodiment, the plurality of output directions of the plurality of directional symbols indicate the directions of up, down, left, or right. In another embodiment, the plurality of output directions of the plurality of directional symbols indicate a diagonal direction. It may be appreciated that the output directions of the directional symbols disclosed herein may indicate any suitable path depending on the configuration of the symbol display position matrix, the position of a directional symbol in the symbol display position matrix, or any other suitable criteria.

In one embodiment, as seen in FIGS. 4A to 4I, the symbol display position matrix may include a plurality of columns and a plurality of rows of square shaped symbol display positions. In different embodiments, one, more or each of the symbol display positions may be any suitable shape, including, but not limited to a circle shape, a triangle shape, a rectangle shape, a pentagon shape, a hexagon shape, a heptagon shape, an octagon shape and/or any polygon shape. In different embodiments, the symbol display positions of the symbol display position matrix may be arranged in any suitable pattern forming any suitable shape including, but not limited to, a circular pattern or matrix, a triangle pattern or matrix, a rectangle pattern or matrix, a pentagon pattern or matrix, a hexagon pattern or matrix, a heptagon pattern or matrix, an octagon pattern or matrix, any polygon pattern or matrix, a brick pattern or matrix, a pattern or matrix of any regular tessellation, and a pattern or matrix of any irregular tessellations, such as a penrose pattern or a Voronoi tessellation.

In another embodiment, one or more of the directional symbols each may include one of a plurality of different output directions, but no input direction. In another embodiment, each of the directional symbols each may include one of a plurality of different output directions, but not input direction. In these embodiments, if the output direction of a generated directional symbol indicates another directional symbol at an adjacent symbol display position, the gaming system either may form a set of directional symbols with these two symbols or may add this other directional symbol to a previously formed set of directional symbols. In these embodiments because one or more of the directional symbols lack an input direction, the gaming system does not determine whether the output direction of any directional symbols are compatible with the input direction of any other directional symbols. Rather, the gaming system may determine whether the output direction of any directional symbols indicate any other directional symbols at adjacent symbol display positions.

In another embodiment, rather than providing the directional symbol game as a wagering game, the gaming system may provide the directional symbol game as a bonus game. In one such embodiment, the gaming system may utilize one or more sub-symbols, such as directional sub-symbols to provide the directional symbol game as a bonus game. For example, each primary game symbol of the primary game may include a directional symbol as a sub-symbol. In this example, in addition to any primary game awards for any winning combination of primary game symbols, the gaming system may determine a bonus award based on if a plurality of the directional sub-symbols associated with a plurality of the primary game symbols form one or more sets of compatible directional sub-symbols.

It may be appreciated that unlike known payline symbol evaluations in which each of the symbol display positions evaluated for each wagered on payline is known prior to the player placing any wagers on any paylines (and thus known prior to any symbols being generated for a play of a game), the directional symbol evaluation disclosed herein may provide that which symbol display positions may be evaluated for each wagered symbol position are unknown prior to the player placing any wagers on any symbol positions (and thus unknown prior to any symbols being generated for a play of a game). That is, the gaming system and method disclosed herein may increase a player's excitement and enjoyment by utilizing certain of the generated symbols (which may include evaluation information encoded in the generated symbol) to determine which others symbols at which other symbol display positions may be evaluated for each wagered on symbol position.

It may be further appreciated that unlike known ways to win symbol evaluations in which a plurality of the symbol display positions evaluated for each wagered on way to win is known prior to the player placing any wagers on any ways to win (and thus known prior to any symbols being generated for a play of a game), the directional symbol evaluation disclosed herein may provide that which symbol display positions may be evaluated for each wagered symbol position are unknown prior to the player placing any wagers on any symbol positions (and thus unknown prior to any symbols being generated for a play of a game). Put differently, unlike a ways to win symbol evaluation in which, based on which ways to win are wagered on, any symbols generated at one or more symbol display positions may not be evaluated for a play of a game, the directional symbol evaluation game disclosed herein may provide that, based on which directional symbols are generated at which symbol display positions, each symbol generated at each symbol display position may potentially be evaluated for a play of the game. For example: (i) in a ways to win symbol evaluation game, the determination of if any symbols generated at the symbol display position of the top row of the fourth reel is based on if that specific symbol display position being included in any wagered on ways to win; and (ii) in the directional symbol evaluation game disclosed herein, the determination of if any symbols generated at the symbol display position of the top row of the fourth reel is based on if any generated directional symbols indicate that specific symbol display position. That is, the gaming system and method disclosed herein may increase a player's excitement and enjoyment by utilizing certain of the generated symbols (which may include evaluation information encoded in the generated symbol) to determine which others symbols at which other symbol display positions may be evaluated for each wagered on symbol position.

It may be appreciated that in different embodiments, one or more of:

i. which directional symbols may be generated in which starting symbol display positions;
ii. which directional symbols may be available to be generated in which starting symbol display positions;
iii. which directional symbols may be available to be randomly generated;
iv. which directional symbols may be available to be randomly generated at which symbol display positions;
v. which directional symbols may be available to be generated by which symbol generators;
vi. a quantity of symbol generators;
vii. a quantity of symbol display positions of one or more symbol generators;
viii. which input directions each directional symbol may have;
ix. which output directions each directional symbol may have;
x. a quantity of input directions each directional symbol may have;
xi. a quantity of output directions each directional symbol may have;
xii. which input directions may be compatible with which output directions;
xiii. which input directions may be incompatible with which output directions;
xiv. which characteristics may be associated with which directional symbols;
xv. which characteristics may be compatible with which other characteristics;
xvi. which characteristics may be incompatible with which other characteristics;
xvii. which directional symbols may be associated with modifiers or multipliers;
xviii. an amount of each modifier or multiplier associated with each of any directional symbols;
xix. which directional symbols may be associated with a static value;
xx. an amount of each static value associated with each of any directional symbols;
xxi. a location of one or more destination positions;
xxii. which directional symbols a player may be enabled to rotate;
xxiii. which directions a player may be enabled to rotate one or more directional symbols;
xxiv. whether to enable a player to utilize a respin feature;
xxv. which directional symbols may be removed if a respin feature is employed;
xxvi. which rows and/or columns a player may be enabled to shift;
xxvii. which directional symbols at which symbol display positions a player may be enabled to swap;
xxviii. which directional symbols a player may be enabled to save; and
xxix. any determination disclosed herein;

may be predetermined, randomly determined, randomly determined based on one or more weighted percentages, determined based on a generated symbol or symbol combination, determined based on a random determination by the central controller, determined based on a random determination at the gaming system, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

It may be understood that various changes and modifications to the presently preferred embodiments described herein will be apparent to those skilled in the art. Such changes and modifications may be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device which stores a plurality of instructions, which when executed by the at least one processor, cause the at least one processor to operate with the at least one input device and the at least one display device to:

(a) enable a player to individually place a wager on each of a plurality of different individual starting positions, (b) generate:

(i) a predetermined directional symbol having a predetermined output direction at each of the plurality of different starting positions, wherein the predetermined output direction is compatible with at least one of a plurality of different input directions and is incompatible with at least another one of the plurality of different input directions, and (ii) a plurality of directional symbols at a plurality of symbol display positions, each directional symbol having at least one of the plurality of different input directions and at least one of a plurality of different output directions, wherein at least one of the input directions is compatible with at least one of the output directions and at least one of the input directions is incompatible with at least one of the output directions, (c) display each of the generated directional symbols, and (d) for each wagered on starting position:

(i) determine a quantity of any adjacent compatible directional symbols in any sets of symbols associated with the wagered on starting position, the determination of the quantity being based, at least in part, on if at least one input direction of at least one of the displayed directional symbols is compatible with at least one output direction of at least another one of the displayed directional symbols, (ii) if a designated quantity of any adjacent compatible directional symbols is determined associated with the wagered on starting position, provide the player an award associated with the designated quantity, wherein a first award is associated with a first quantity of adjacent compatible directional symbols and a second, different award is associated with a second, different quantity of adjacent compatible directional symbols, and (iii) if no designated quantity of any adjacent compatible directional symbols is determined associated with the wagered on starting position, provide no award to the player in association with said wagered on starting position.

2. The gaming system of claim 1, wherein a determination of if at least two adjacent directional symbols are compatible is based on whether the output direction of a first directional symbol generated at a first symbol display position is compatible with the input direction of a second directional symbol generated at a second symbol display position, the second symbol display position being adjacent to the first symbol display position and indicated by the output direction of the first directional symbol.

3. The gaming system of claim 1, wherein at least one of the directional symbols has at least one of: a plurality of the different input directions and a plurality of the different output directions.

4. The gaming system of claim 1, wherein at least one of the directional symbols is associated with a modifier.

5. The gaming system of claim 4, wherein when executed by the at least one processor, the plurality of instructions cause the at least one processor to modify the determined quantity of any adjacent compatible directional symbols if at least one of the adjacent compatible directional symbols is associated with at least one modifier.

6. The gaming system of claim 1, wherein when executed by the at least one processor, the plurality of instructions cause the at least one processor to randomly generate a plurality of the directional symbols at a plurality of the symbol display positions.

7. A method of operating a gaming system, the method comprising:

(a) enabling a player to individually place a wager on each of a plurality of different individual starting positions, (b) causing at least one processor to execute a plurality of instructions to generate:

(i) a predetermined directional symbol having a predetermined output direction at each of the plurality of different starting positions, wherein the predetermined output direction is compatible with at least one of a plurality of different input directions and is incompatible with at least another one of the plurality of different input directions, and (ii) a plurality of directional symbols at a plurality of symbol display positions, each directional symbol having at least one of the plurality of different input directions and at least one of a the plurality of different output directions, wherein at least one of the input directions is compatible with at least one of the output directions and at least one of the input directions is incompatible with at least one of the output directions, (c) causing at least one display device to display each of the generated directional symbols, and (d) for each wagered on starting position:

(i) causing the at least one processor to execute the plurality of instructions to determine a quantity of any adjacent compatible directional symbols in any sets of symbols associated with the wagered on starting position, the determination of the quantity being based, at least in part, on if at least one input direction of at least one of the displayed directional symbols is compatible with at least one output direction of at least another one of the displayed directional symbols, (ii) if a designated quantity of any adjacent compatible directional symbols is determined associated with the wagered on starting position, providing the player an award associated with the designated quantity, wherein a first award is associated with a first quantity of adjacent compatible directional symbols and a second, different award is associated with a second, different quantity of adjacent compatible directional symbols, and (iii) if no designated quantity of any adjacent compatible directional symbols is determined associated with the wagered on starting position, causing the at least one processor to execute the plurality of instructions to provide no award to the player in association with said wagered on starting position.

8. The method of claim 7, wherein a determination of if at least two adjacent directional symbols are compatible is based on whether the output direction of a first directional symbol generated at a first symbol display position is compatible with the input direction of a second directional symbol generated at a second symbol display position, the second symbol display position being adjacent to the first symbol display position and indicated by the output direction of the first directional symbol.

9. The method of claim 7, wherein at least one of the directional symbols has at least one of: a plurality of the different input directions and a plurality of the different output directions.

10. The method of claim 7, wherein at least one of the directional symbols is associated with a modifier.

11. The method of claim 10, which includes causing the at least one processor to execute the plurality of instructions to modify the determined quantity of any adjacent compatible directional symbols if at least one of the compatible directional symbols is associated with at least one modifier.

12. The method of claim 7, which includes causing the at least one processor to execute the plurality of instructions to randomly generate a plurality of the directional symbols at a plurality of the symbol display positions.

13. The method of claim 7, which is provided through a data network.

14. The method of claim 13, wherein the data network is an internet.

15. A non-transitory computer readable medium including a plurality of instructions, which when executed by at least one processor, cause the at least one processor to:

(a) enable a player to individually place a wager on each of a plurality of different individual starting positions, (b) generate:

(i) a predetermined directional symbol having a predetermined output direction at each of the plurality of different starting positions, wherein the predetermined output direction is compatible with at least one of a plurality of different input directions and is incompatible with at least another one of the plurality of different input directions, and (ii) a plurality of directional symbols at a plurality of symbol display positions, each directional symbol having at least one of the plurality of different input directions and at least one of a plurality of different output directions, wherein at least one of the input directions is compatible with at least one of the output directions and at least one of the input directions is incompatible with at least one of the output directions, (c) cause at least one display device to display each of the generated directional symbols, and (d) for each wagered on starting position:

(i) determine a quantity of any adjacent compatible directional symbols in any sets of symbols associated with the wagered on starting position, the determination of the quantity being based, at least in part, on if at least one input direction of at least one of the displayed directional symbols is compatible with at least one output direction of at least another one of the displayed directional symbols, (ii) if a designated quantity of any adjacent compatible directional symbols is determined associated with the wagered on starting position, provide the player an award associated with the designated quantity, wherein a first award is associated with a first quantity of adjacent compatible directional symbols and a second, different award is associated with a second, different quantity of adjacent compatible directional symbols, and (iii) if no designated quantity of any adjacent compatible directional symbols is determined associated with the wagered on starting position, provide no award to the player in association with said wagered on starting position.

16. The non-transitory computer readable medium of claim 15, wherein a determination of if at least two adjacent directional symbols are compatible is based on whether the output direction of a first directional symbol generated at a first symbol display position is compatible with the input direction of a second directional symbol generated at a second symbol display position, the second symbol display position being adjacent to the first symbol display position and indicated by the output direction of the first directional symbol.

17. The non-transitory computer readable medium of claim 15, wherein at least one of the directional symbols has at least one of: a plurality of the different input directions and a plurality of the different output directions.

18. The non-transitory computer readable medium of claim 15, wherein at least one of the directional symbols is associated with a modifier.

19. The non-transitory computer readable medium of claim 18, wherein when executed by the at least one processor, the plurality of instructions cause the at least one processor to modify the determined quantity of any adjacent compatible directional symbols if at least one of the adjacent compatible directional symbols is associated with at least one modifier.

20. The non-transitory computer readable medium of claim 15, wherein when executed by the at least one processor, the plurality of instructions cause the at least one processor to randomly generate a plurality of the directional symbols at a plurality of the symbol display positions.

* * * * *